United States Patent [19]

Szabo

[11] Patent Number: 4,858,915

[45] Date of Patent: Aug. 22, 1989

[54] WEIGHT-BIASED FITNESS MACHINE

[76] Inventor: William J. Szabo, 10126 Langmuir Ave., Sunland, Calif. 91040

[21] Appl. No.: 882,165

[22] Filed: Jul. 2, 1986

[51] Int. Cl.[4] ..... A63B 21/06

[52] U.S. Cl. ..... 272/117; 272/134

[58] Field of Search ..... 272/117, 118, 123, 125, 272/129, 134

[56] References Cited

U.S. PATENT DOCUMENTS

| | | | |
|---|---|---|---|
| Re. 31,170 | 3/1983 | Mazman | 272/118 |
| 190,150 | 5/1877 | Lozier . | |
| 799,270 | 9/1905 | Roland . | |
| 2,356,260 | 8/1944 | Maxwell . | |
| 3,573,865 | 4/1971 | Annas et al. | 272/134 X |
| 3,588,101 | 6/1971 | Jongreis | 272/117 |
| 3,638,941 | 2/1972 | Kulkens . | |
| 3,902,717 | 9/1975 | Kulkens | 272/134 |
| 4,154,441 | 5/1979 | Gajda | 272/117 X |
| 4,253,662 | 3/1981 | Podolak | 272/123 |
| 4,344,619 | 8/1982 | Szabo | 272/117 |
| 4,354,675 | 10/1982 | Barclay et al. | 272/118 |
| 4,609,189 | 9/1986 | Brasher | 272/129 X |
| 4,627,614 | 12/1986 | De Angeli | 272/117 |
| 4,650,185 | 3/1987 | Cartwright | 272/117 |
| 4,725,054 | 2/1988 | Jolow et al. | 272/134 X |

FOREIGN PATENT DOCUMENTS

| | | |
|---|---|---|
| 2200544 | 7/1978 | Fed. Rep. of Germany . |
| 3332520 | 3/1985 | Fed. Rep. of Germany . |
| 3341061 | 5/1985 | Fed. Rep. of Germany . |
| 2146910 | 5/1985 | United Kingdom . |

*Primary Examiner*—Richard J. Apley
*Assistant Examiner*—Robert W. Bahr
*Attorney, Agent, or Firm*—Christie, Parker & Hale

[57] ABSTRACT

An exercise apparatus as described and includes a support, a lever arm pivotally mounted to the support adjacent a first lever end. An exercise fitting, such as handle bars and other linkages, are placed adjacent a second end of the lever arm for allowing pivoting of the lever arm. Weights are movable along the lever arm a distance between the first and second ends and such that the movement has a horizontal component with respect to the support. A motor is provided for moving the weights.

44 Claims, 18 Drawing Sheets

5
6

Fig. 8.
Fig. 7.
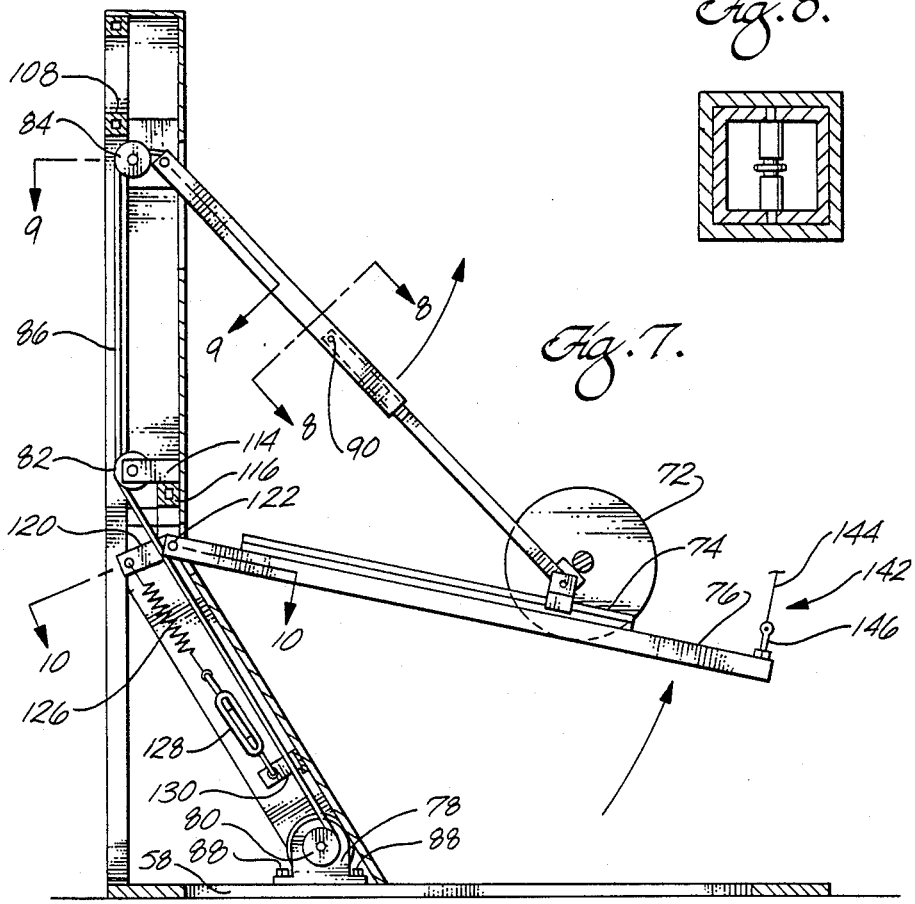
Fig. 9.
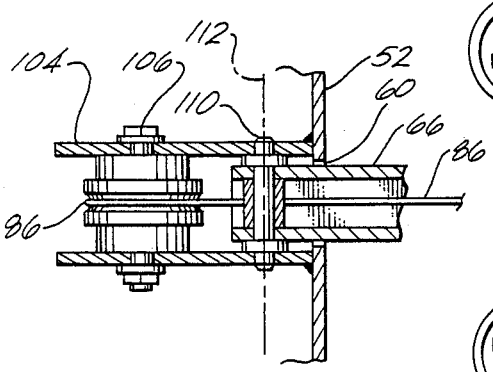
Fig. 10.
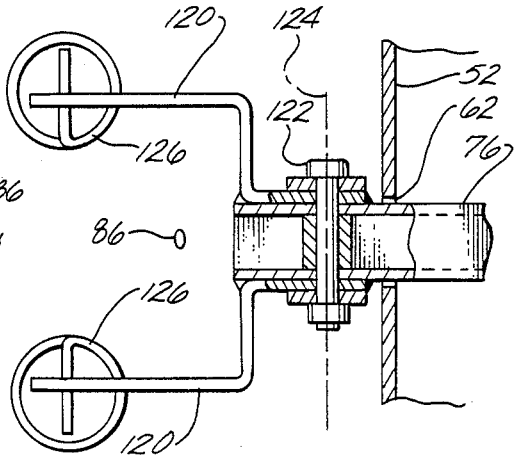

342
346
348
344
320
330
310
332
334
240
322
336
338
326
324
314
312
316
318
308
306

386
394

406
398
408
402
382
412
416
414
404
410
400
416

388
394
386
418
420
35
35
422
392
384
396
390

388
428
430
432
410
412
416
426
414
414
414
414
386

WEIGHT-BIASED FITNESS MACHINE

BACKGROUND OF THE INVENTION

In recent years, our society has developed an increased interest in health and physical fitness. A popular method of improving physical fitness and maintaining better health involves weight lifting. Health spas have blossomed around the country, offering a wide range of weight lifting equipment.

Generally, different types of weight lifting machines have been developed to exercise particular muscle groups. For example, there are different weight lifting machines available to exercise the biceps, triceps, deltoids, latissimus dorsi, quadriceps, and calf muscles, to name a few.

Most conventional weight lifting machines available today function by a lever or pulley mechanism or some combination of both of these. Generally, a stack of weights is placed at a fixed spot on a lever or at the end of a pulley cable. Each weight in the stack has an orifice for the insertion of a metal pin. Insertion of the pin in a particular orifice results in all the weights above the pin serving as the resisting force when an exercise is performed. An appropriate handle is attached at the other end of the lever or pulley, depending on the exercise that is to be performed. The amount of weight can be varied in discrete increments by changing the position of the metal pin. In some types of pulley machines, a gear mechanism of a particular shape, such as a kidney shape, rests between the weights and the handle to vary the amount of input required to lift a given amount of weight as a function of the distance that the weights have been lifted.

In order to achieve maximum results from weight lifting, whether it is desired to add muscle bulk or increase muscle definition, it is important that a particular muscle being exercised fail completely by the end of the exercise. Each muscle group is composed of various sub-muscle groups. When a person bench presses, for example, 200 pounds for a number of repetitions until he can no longer perform another repetition, only the weakest sub-muscle groups within the pectoralis (chest) muscle will have failed. In order to achieve failure of the remaining sub-muscle groups, the amount of weight being lifted would need to be decreased until further repetitions could be performed. Optimally, the effective weight should be continuously decreased until all of the sub-muscle groups have failed.

In order to decrease the effective weight being lifted on conventional equipment, the exerciser must stop the exercise, get up from the machine, change the position of the pin, get back on the machine, and continue to exercise. By the time all this has taken place, the sub-muscle groups that failed have substantially recovered. Thus, when the exercise is resumed, these sub-muscle groups are once again being used, and the desired failure of the remaining sub-muscle groups will not occur. In addition, on conventional equipment, the effective weight may be reduced or increased only in discrete increments. These increments may be too large to isolate and cause failure of specific sub-muscle groups.

It would be extremely advantageous to have a weight lifting apparatus which allows the continuous variation of the effective weight, the controls for such variation being accessible to the exerciser while in the exercise position, and such variation being possible while the exerciser is performing an exercise stroke. The present invention satisfies these needs and provides other related advantages.

SUMMARY OF THE INVENTION

The present invention resides in a lever-type weight lifting apparatus whereby the effective weight being lifted can be continuously varied by the exerciser while performing a weight lifting exercise. A fixed amount of weight is positioned on a lever arm to be lifted by the exerciser. The effective weight being lifted can be varied by changing the position of the weight on the lever arm.

The weight lifting apparatus of the present invention provides significant and dynamic advantages over conventional weight lifting apparati. The present invention allows the value of the weight (i.e., resistance) to be adjusted by the exerciser while in the exercise position without interrupting the range of movement required by a specific exercise. Moreover, the effective resistance can be varied during a particular exercise stroke to provide for optimal failure of all sub-muscle groups. The weight lifting apparatus in the present invention is also such that the lever, weight, and pulley mechanism can be constructed with different interactive muscle-exercising parts so that different machines can be constructed to exercise all of the muscle groups in the body using the same basic lever, weight, and pulley system.

Generally speaking, the weight lifting apparatus of the present invention comprises an upright housing assembly containing a pulley system and motor. A support arm extends downward at an angle from the top section of the housing. The bottom of the support arm is fastened to a weight bar onto which are placed the weights to be lifted. The support arm rests on a sliding track which, in turn, rests on a lever arm that extends angularly downward from the lower section of the housing to the base plate of the weight lifting apparatus resting on the ground. A cable is wound around a pulley wheel on the pulley motor in the housing and runs upward through the housing around various pulley wheels and down into the support arm. The support arm is comprised of an upper outer support tube and a lower inner support tube, the inner support tube fitting into the outer support tube. The end of the cable is attached to the top of the inner support tube.

The weight bar at the end of the support tube slides along the sliding track on the lever arm as the cable is wound around the pulley motor. Gravity positions the weight bar holding the weights as far down the lever arm as it will go until the cable is taut. As the cable is wound further around the pulley motor, the inner support tube is drawn upward into the outer support tube, and the weight bar moves upward along the sliding track on the lever arm. As the cable is unwound from the pulley motor, the inner support tube withdraws from the outer support tube, and the weight bar holding the weights moves downward along the sliding track on the lever arm. Movement of the cable around the pulley motor may be either electronically or mechanically controlled.

At the point of entry of the lever arm into the housing, the lever arm is rigidly attached to a pivot arm, the point of attachment being a pivot point. Springs are connected to the pivot arm at their one end and are attached to a fixed point in the housing at their other end. As the lever arm is lifted from the point at which it contacts the ground or base plate of the apparatus, the lever arm-pivot arm rigid assembly pivots about the pivot point, and the springs compress as the pivot arm moves downward. As the lever arm is returned to its resting position, the springs expand and act as a counterforce to the downward movement of the lever arm.

The position of the weight bar holding the weights on the lever arm determines the effective resistance when an upward force is applied to the opposite end of the lever arm. The closer the weights are to the point of application of the upward force on the lever arm, the higher the effective resistance the lifting force will encounter; thus, the heavier the effective weight being lifted. In this lifting motion, the lever arm acts as a lever in lifting the weights. As the position of the weights is moved upward along the lever arm toward the housing, the length of the effective lever arm is increased, and thus the effective weight being lifted is decreased.

The exercise apparatus of the present invention is extremely versatile in that it can be constructed with different front sections for exercising all of the muscle groups in the body. In all cases, the force applied to lift the weights on the lever arm will always be vertically applied to the end of the lever arm that rests on the ground. This force can be applied by a pulley-type system as, for example, in exercising the latissimus dorsii (side muscles), or by direct connection of other components, such as when exercising the pectoralis (chest muscle).

The weight lifting apparatus of the present invention provides dynamic advantages over other weight lifting equipment currently known in the art. The equipment is relatively simple and inexpensive to construct, yet enables the exerciser to continuously vary the effective resistance while performing a particular exercise, even during an exercise stroke. This enables failure of all of the sub-muscle groups within a particular muscle, providing optimal results.

Other features and advantages of the present invention will become apparent from the following detailed description, which, when read in conjunction with the accompanying drawings, illustrates, by way of example, the principle of the invention.

BRIEF DESCRIPTION OF THE DRAWINGS

FIG. 7 is a side sectional view of the weight lifting apparatus of FIG. 5 in the middle of a lifting stroke;

FIG. 8 is a sectional exploded view of a weight support taken along line 8—8 of FIG. 7;

FIG. 9 is a sectional exploded view of a pulley and cable forming part of the weight support taken along line 9—9 of FIG. 7;

FIG. 10 is a sectional exploded view of part of a lever arm assembly taken along line 10—10 of FIG. 7;

Figures 34, 35:
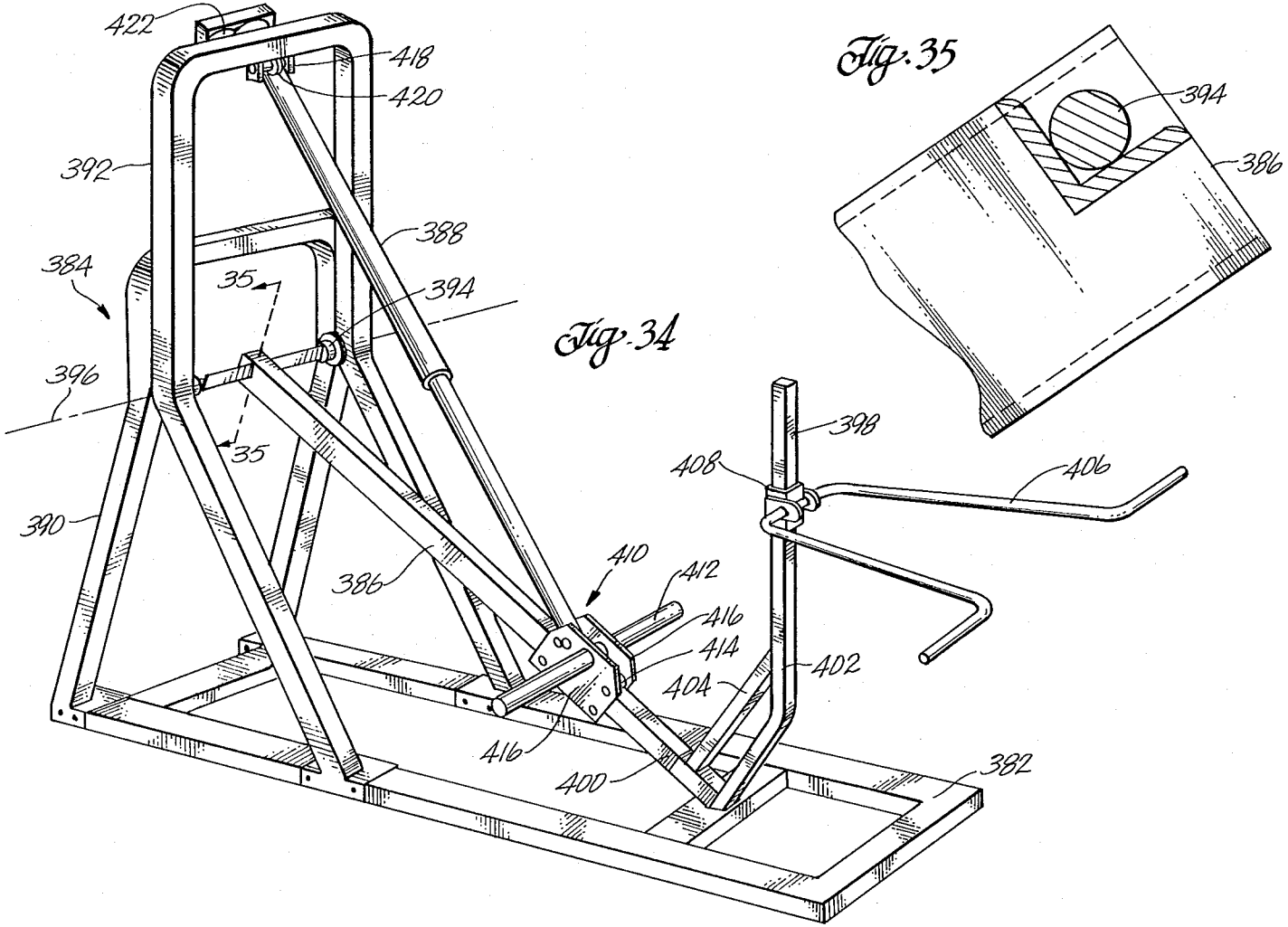
FIG. 34 is a perspective view of a further embodiment of the present invention.
Figure 36:
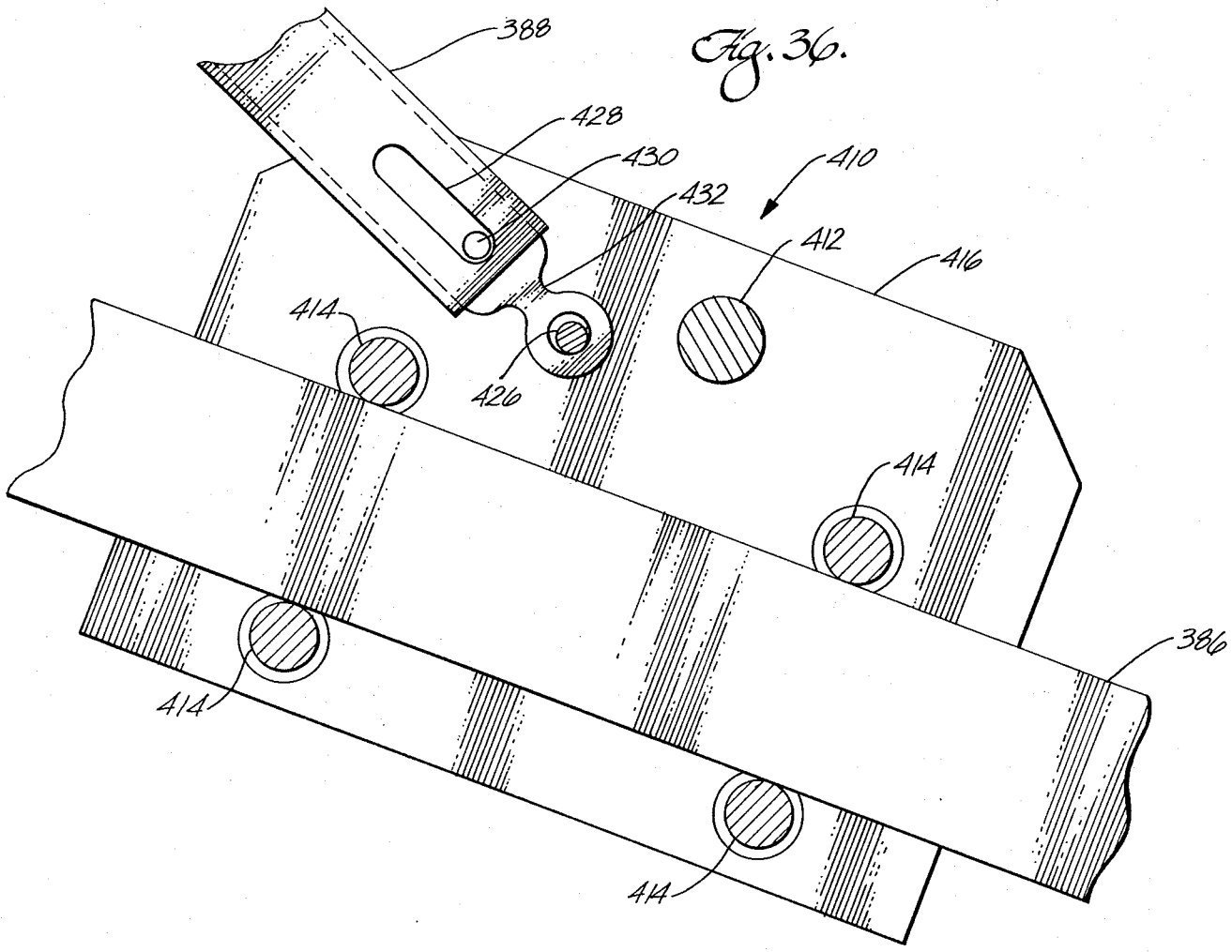
Figures 37, 38:
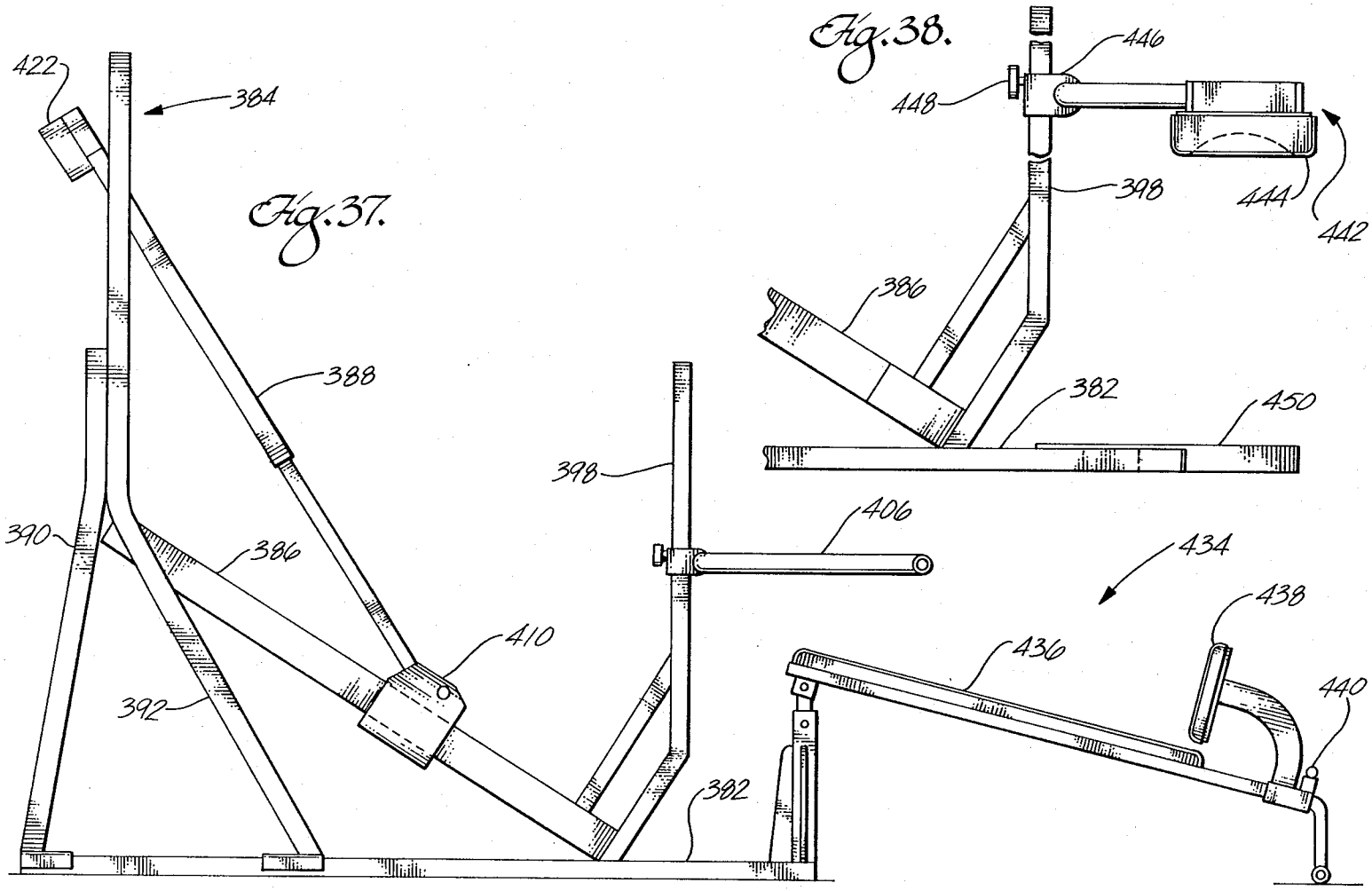
Figure 39:
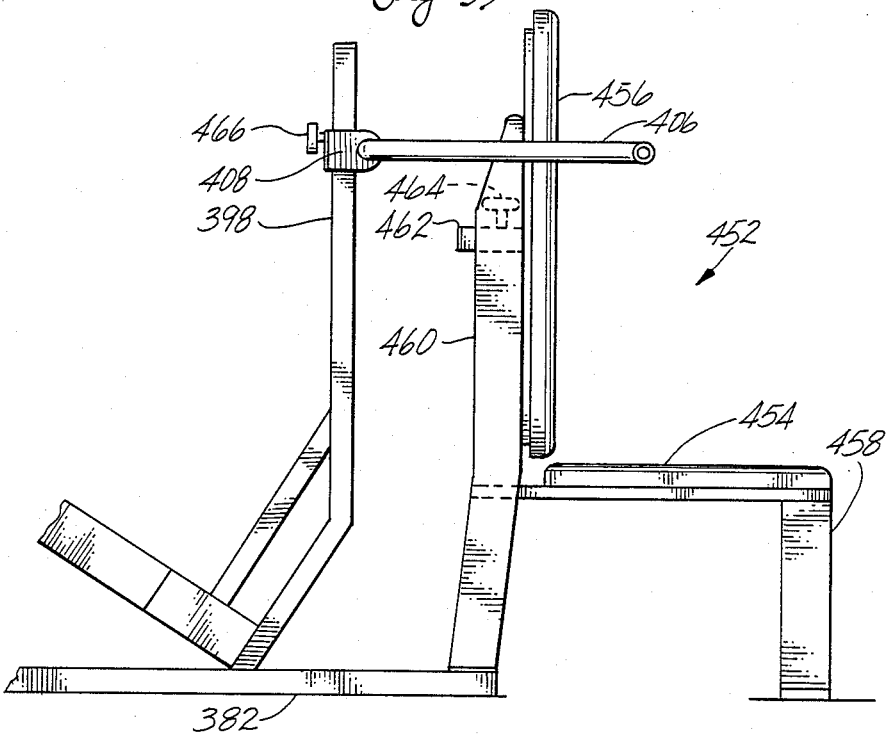
Figure 40:
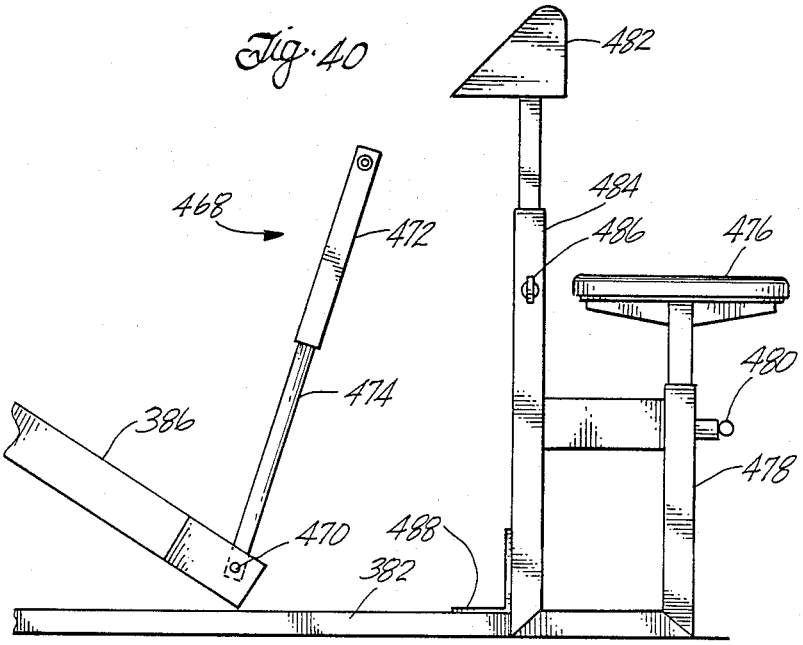
Figure 41:
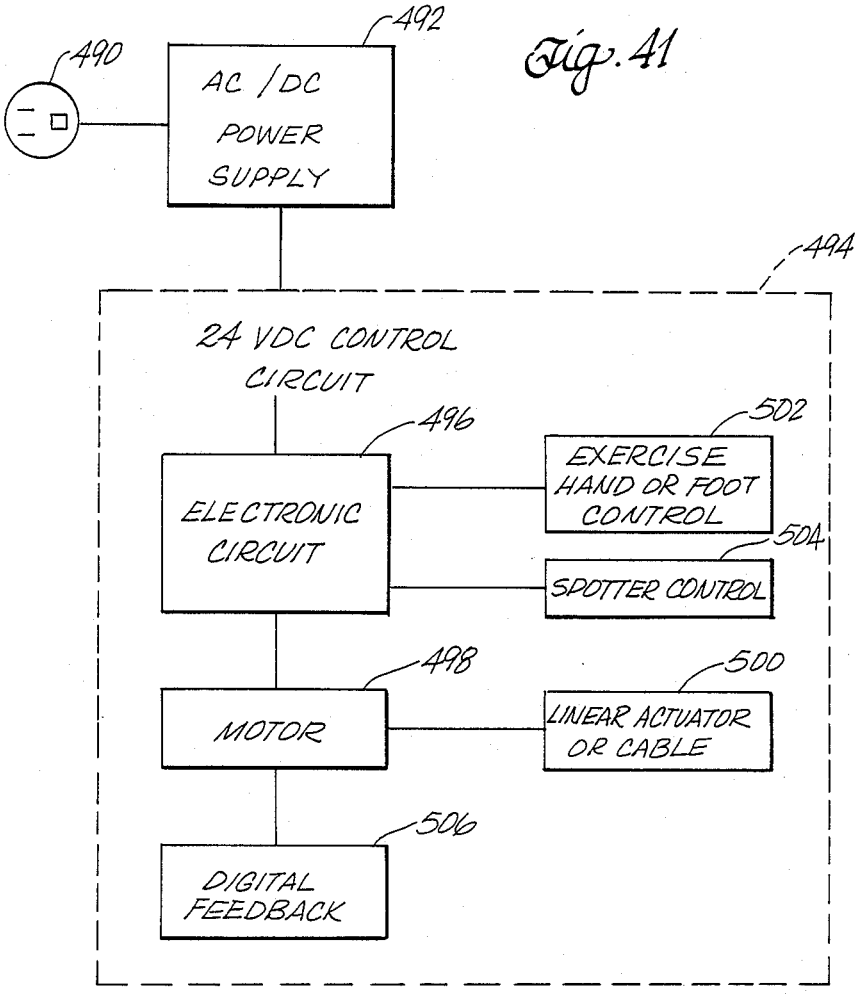

FIG..35 is a partial side section of a portion of the apparatus of FIG. 34;

FIG. 36 is a partial side section of a carriage arrangement for the exercise apparatus of FIG. 34;

FIG. .37 is a side elevation view of the exercise apparatus of FIG. 34 and further showing an exerciser-interface means in the form of an incline bench;

FIG. 38 is a side elevation view of part of an exerciser-interactive means in the form of a shoulder pad arrangement for use with the apparatus of FIG. 34;

FIG. 39 is a side elevation view of an exerciser-interactive means for use with the apparatus of FIG. 34;

FIG. 40 is a side elevation view of a further exerciser-interactive means for use with the exercise apparatus of FIG. 34; and FIG. 40A is a schematic and block diagram of an electronic circuit for use with the apparatus of the present invention.

DETAILED DESCRIPTION OF THE PREFERRED EMBODIMENTS

The present invention is embodied in a weight lifting apparatus in which the effective resistance, i.e., effective weight being lifted, can be continuously varied by the exerciser from the exerciser position in the middle of, or between, exercise strokes. More specifically, the weight lifting apparatus comprises a lever arm pivotable about a pivot point and against which resistance means or weights bear, such that the weights are capable of being shifted to different positions on the lever arm. The further the position of the weights bearing on the lever arm is from the point of application of upward force on the lever arm and closer to the pivot point, the lower the effective resistance will be. Different exerciser-interactive sections can be attached to the lever arm, or to other parts of the apparatus, so that different machines can be constructed in accordance with the present invention to exercise different muscle groups in the body.

The ability of the weight lifting apparatus of the present invention to allow the effective resistance to vary continuously and be controlled by the exerciser from the exercising position while performing exercises permits all muscles in the particular group being worked to be exercised without a loss of intensity between repetitions. This allows a particular muscle to be worked until all muscle sub-groups within that muscle fail, thereby achieving optimum results. Moreover, the apparatus of the present invention is relatively simple and inexpensive to construct.

Figure 1:
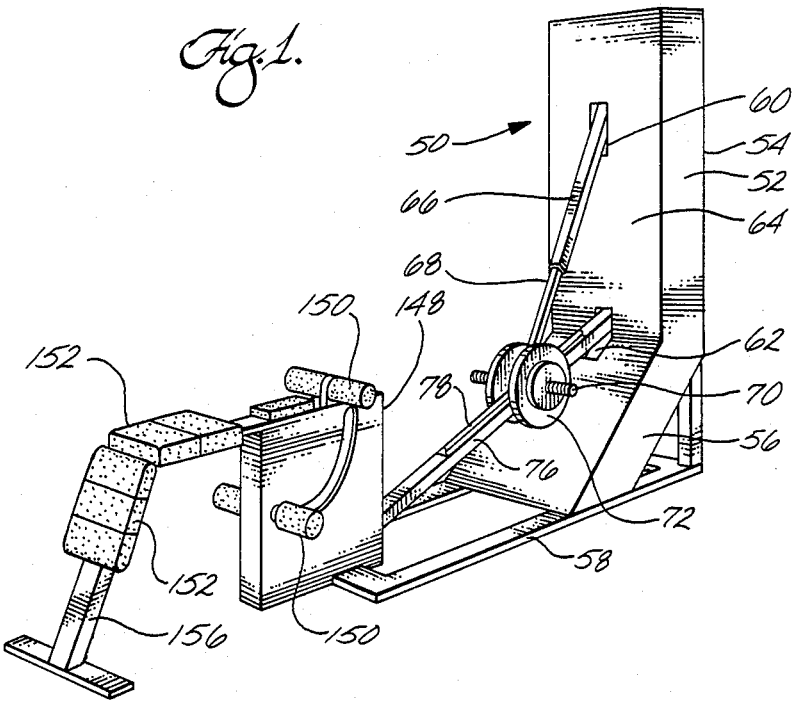
FIG. 1 is a perspective view of one embodiment of a weight lifting apparatus of the present invention.

The weight lifting apparatus of the present invention is shown in detail in the accompanying drawings. As shown in FIG. 1, the weight lifting apparatus, generally designated by the numeral 50, comprises a housing 52 having a full upright section 54 and an angular section 56. The housing generally covers much of the hardware, such as the motor, pulleys, and springs described below. The upright section 54 and the angular section 56 meet to form an obtuse angle therebetween. The angular section of the housing extends downward and is mounted to a base plate 58.

The upright section includes a vertical aperture 60. There is also an angled aperture 62 at the angular intersection between the upright section of the housing and the angular section. A support tube 64 includes an outer support tube 66 and an inner support tube 68 freely slidable within the interior of the outer support tube 66. The support tube 64 extends through the vertical aperture 60 for partly supporting weights (to be described below) from above the weights and for allowing movement of the weights toward and away from the vertical housing. A weight bar 70 is coupled to the lower end of the inner support tube for supporting weights 72 used in conducting exercises. The support tube also provides lateral support of the weights and weight bar. This prevents twisting of the weights and weight bar with respect to the track rail assembly. The inner dimensions of the outer support tube and the outer dimensions of the inner support tube are selected to provide free movement of the inner support tube with respect to the outer support tube. Roller bearings may be provided between the inner and outer support tubes to allow free sliding therebetween.

A carriage, described more fully below with respect to FIGS. 5 and 6, couples the weight bar to the end of the support tube 64. The carriage rests on a track rail 74 for movement along a lever arm 76 extending through the angular aperture 62. The lever arm may be formed from 2"×2" tubing. However, other dimensions, such as 2"×4" tubing may be used to provide additional structural support. The carriage, and therefore the weights, move along the track rail when a force is applied directly or indirectly by a person exercising at one end of the lever arm by pivoting the lever arm about a fixed point within the housing 52 at its other end. In the present embodiment, the lever arm extends downward from the angular aperture 62 to a point in a plane defined by the base plate 58. In most instances, the plane is the same as the ground.

Figures 4, 5, 6:
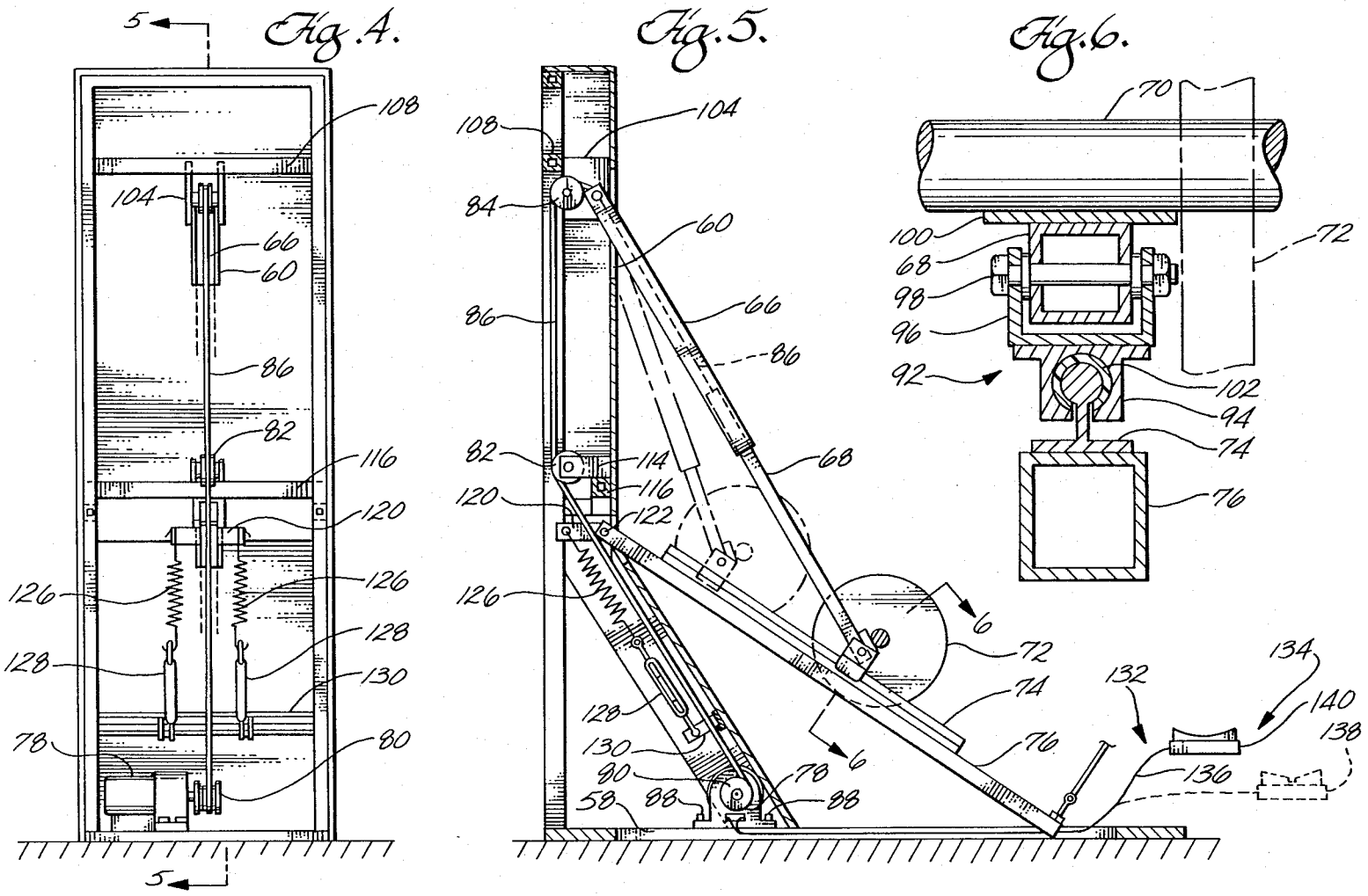
FIG. 4 is a rear sectional view of the weight lifting apparatus of FIG. 1.
FIG. 5 is a side sectional view of the weight lifting apparatus taken along line 5—5 of FIG. 4.
FIG. 6 is an exploded sectional view of a lever arm and weight carriage of the embodiment of FIG. 5 taken along line 6—6 of FIG. 5.

Considering the details of the apparatus shown in FIGS. 4–6, means are provided for movably positioning the weights along the lever arm at various points between the point of application of force on the lever arm 76 and the point about which the lever arm pivots, thereby changing the effective resistance to the force applied to the end of the lever arm. The means for movably positioning the weights include a pulley system made up of a pulley motor 78, a motor pulley wheel 80, a housing pulley wheel 82, a support bar pulley wheel 84, and a cable 86. The pulley motor is mounted to the base 58 through bolts 88 and is preferably positioned behind the angular section 56. The pulley cable is wound at one end around the motor pulley wheel 80 and is passed behind the angular section 56 to the housing pulley wheel 82 and behind and over the support arm pulley wheel 84 to extend inside the support tube 64. As shown in FIG. 8, means are provided for connecting the pulley cable 86 to the weights for supporting the weights from above and for allowing free movement of the weights according to play-out or retraction of the cable. Because the lever arm is preferably kept in a position sloping toward the ground during the exercise movements, the weights are pulled downward by gravity along the lever arm until the pulley cable is taut.

The position of the weights with respect to the lever arm can then be adjusted by winding and unwinding the pulley cable around the pulley wheel of the motor. The other end of the cable is fastened to a cable-fastening support 90, extending across the inside of the end of the inner support tube 68 interior to the outer support tube 66. The other end of the inner support tube is linked to, as shown in FIG. 6, a carriage 92 linearly slidable along the lever arm as a function of the play-out and retraction of the cable. The inner support tube also has the weight bar 70 attached to the top of the tube adjacent the carriage. In an alternative embodiment, the weight bar may be mounted directly to the carriage so that the inner support tube supports the combination of the carriage and the weights through a single connection.

In the embodiment of the carriage shown in FIG. 6, the carriage is mounted through a linear bearing assembly 102 in the form of a track slide 94 to be slidably movable along the track rail 74. The track slide supports a U-shaped bracket 96 through which the inner support tube 68 is pivotally mounted with a nut-and-bolt assembly 98. The weight bar 70 is mounted to a top of the inner support tube through a mounting plate 100. The linear bearing assembly 102 preferably includes linear Teflon bearings to provide a low coefficient of friction between the track slide and the track rail.

As shown in FIGS. 4 and 9, the support arm pulley wheel is mounted in a bracket 104 for supporting the pulley through a nut-and-bolt assembly 106. The pulley may be rotatably mounted through a bearing assembly, as desired. The bracket is, in turn, mounted to the frame of the apparatus through cross member 108.

The upper end of the outer support tube 66 extends through the vertical aperture 60 in the full upright section 54 and is pivotally mounted to the bracket 104 through a bearing assembly 110. The outer support tube can then pivot about a horizontal axis 112 as the support tube moves with the lever arm 76.

As shown in FIGS. 4 and 5, the housing pulley wheel 82 is mounted through a bracket 114 to a cross member 116 through a bearing assembly similar to that described with respect to the support arm pulley wheel. The cross member mounts the pulley wheel to the frame.

As shown in FIG. 10, means 118 are provided for biasing the lever arm 76 to counteract the weight of the lever arm. This decreases the effect of the lever arm so that the effective weight felt by the exerciser is closer to the total mass of the weights placed on the weight bar.

The upper end of the lever arm 76 extends through aperture 62 in housing 52 and is rigidly attached to pivoting arms 120 by nut-and-bolt assembly 122. The entire rigid assembly, consisting of pivoting arms 120 and lever arm 76, pivots at nut-and-bolt assembly 122 about a horizontal axis 124.

Springs 126 are attached at one end to pivot arms 120 and at the other end to turnbuckles 128, as shown in FIGS. 4 and 5. Turnbuckles 128 are, in turn, fastened to brace member 130, which horizontally spans the lower portion of housing 52. The tension of springs 126 can be adjusted by using turnbuckles 128.

Means 132 are provided for controlling movement of the weights with respect to points along the lever arm 76. The controlling means permits the exerciser to control the movement of the weights while the exerciser is in the exercise position. The controlling means includes a remote control 134 coupled to a cable 136 electrically connected to the pulley motor 78. An electronic circuit is provided in the controlling means for reversing or advancing the pulley motor to retract or play out the cable, as desired, for repositioning the weights with respect to the lever arm. In this manner, an exerciser can change the effective resistance being lifted while staying in the exercise position. Use of the controlling means causes the weight bar 70 to move along the track rail 74, thereby changing the position of the weight bar on the lever arm.

By positioning the controlling means 132, either as a foot switch 138, shown in phantom in FIG. 5, or as a finger switch 140, the exerciser can vary the effective resistance by changing the position of the weights, even during a particular exercise cycle. For example, if an exerciser finds, during a particular exercise cycle or repetition, that the cycle cannot be completed, the effective resistance felt by the exerciser can be decreased by actuating the foot switch 138 to reverse the motor and retract the cable. This moves the weights and the carriage 92 upward along the lever arm 76 toward the pivot point of the lever arm, i.e., axis 124. A certain point will be reached on the lever arm whereby the effective resistance produced by the weights on the lever arm is decreased sufficiently to allow the exerciser to finish the particular exercise cycle. Additionally, if an exerciser trains on a regular basis, the exerciser will know the capability for completing an exercise regimen. Therefore, the effective resistance felt by the exerciser can be decreased, as appropriate, at the end of each exercise cycle, for example. To elaborate further, an exerciser may wish to exercise at 90% of maximum potential. During the first cycle or repetition of the exercise, this may be an effective weight of 90 pounds, for example. The exerciser may be able to lift the 90 pounds for several cycles. In order to gain full advantage of the exercise regimen, ten cycles or repetitions should be completed. However, as the muscle sub-groups begin to fail, the exerciser cannot lift the full 90 pounds to the end of the exercise regimen. Therefore, the exerciser decreases the effective resistance being lifted when the exerciser feels that a cycle cannot be completed. The exerciser decreases the effective weight to 85 pounds, for example. The exerciser can then continue doing cycles until additional muscle sub-groups begin to fail. The process continues by the exerciser continuing the cycles and decreasing the effective resistance being felt, thereby requiring additional muscle sub-groups to fail during the exercise regimen. Theoretically, it is desirable to have most of the muscle sub-groups fail by the time the last cycle is completed. At this point, the effective resistance being felt by the exerciser may be down to 5 or 10 pounds. However, the exerciser will have completed the ten repetitions and taken full advantage of the complete exercise regimen. With the present design allowing for user adjustment of the weights, the particular type of training may be adjusted as desired. For example, for ten repetitions, the exerciser can begin with a very heavy resistance to movement and end with a relatively light resistance. Conversely, the exerciser can begin with a light resistance during the first few repetitions and gradually increase with a heavy resistance. By starting out heavy and ending light, the exerciser exercises with the maximum of intensity so that the maximum number of muscle sub-groups fail by the end of the exercise regimen. By starting out light, the exerciser can warm up with various repetitions, as desired, and then build up to a more intense exercise.

In an alternative embodiment, the foot switch or finger switch may be operated by a spotter familiar with the exerciser's regimen. At the point where the exerciser cannot do any more cycles, the effective resistance is decreased by retracting the cable and moving the weights closer to the pivot point of the lever arm. The exerciser can then continue the cycles until such time as additional muscle sub-groups fail, at which point the spotter again decreases the effective resistance being felt by the exerciser. In a further alternative embodiment, the foot and hand switches may be electrically coupled in parallel so that either the hand switch or the foot switch would operate the weight-moving means.

FIG. 5 shows weight bar 70 and weights 72 after they have been moved upward along lever arm 76. Inner support tube 68 is inserted further into outer support tube 66, cable 86 still being taut and holding weights 72 in place against the force of gravity tending to pull them in a downward direction along lever arm 76. Upon transmission of an appropriate electronic signal from switch 134, pulley motor 78 unwinds cable 86 from pulley wheel 80, thereby allowing the force of gravity to pull weight bar 70 and weights 72 with the carriage 92 downward along track rail 74. Aperture 60 in housing 52 is large enough so that there is free movement of inner support tube 64 as weight bar 70, weights 72, and carriage 92 move within their full range along track rail 74.

The relative position of the carriage affects the particular rate of change of the resistance during a given cycle. When the carriage 92 is at a lowermost position, so that the support tube is fully extended, the angle between the support tube and the lever arm is a minimum. As a result, movement of the lever arm through an arc will cause the carriage to move along the track rail a given distance. When the carriage is at the uppermost position, as represented in phantom in FIG. 5, the angle between the support bar and the lever arm is relatively large. Movement of the lever arm through a given cycle causes the carriage to move through a second distance greater than the first. As a result, the change in resistance felt by the user for a given incremental movement of the lever arm is greater when the carriage is closer to the pivot point of the lever arm. In other words, the rate of change of the resistance felt by the user for a given arcuate motion of the lever arm is greater when the carriage is closer to the pivot point. By changing the position of the carriage during or between repetitions, the rate of change of the resistance felt by the user during a given cycle is necessarily changed also. This is generally beneficial in the current design. For example, when the carriage is closest to the pivot point, the total resistance felt by the exerciser is less, and the rate of change of the resistance during movement of the lever arm is less. The exerciser is more able to accommodate this lesser change in resistance during the cycle. However, when the carriage is furthest from the pivot point, and therefore when the resistance felt by the user is greatest, the rate of change of the resistance during a particular cycle is greater.

Various means 42 may be provided for allowing an exerciser to interact with the weight lifting apparatus, as described above. Very generally, the interacting means 42 may include a cable or chain 144 mounted to the free end of the lever arm through a pin or eyebolt 146. Various additional arrangements for allowing the exercise to interact with the weight lifting apparatus are described more fully below.

A scale (not shown) may be provided on the lever arm visible to the exerciser or to a spotter for indicating the effective resistance being felt by the exerciser as a function of the position of the carriage 92. The information on the scale will depend upon the position of the carriage, the mass of the weights placed on the weight bar, the particular type of interactive means 142 coupled to the end of the lever arm, and the spring constant and length of the springs 126. However, several of these variables may be fixed once the type of springs are determined and the particular interactive means is attached.

Most of the parts of the weight lifting apparatus of the present invention can be constructed of steel or similar high-strength material. Where metal parts are fastened or attached together, conventional methods, such as welding, riveting, etc., may be used. By way of dimensions, the inner support tube 64 has a cross-section of $1\frac{3}{4}''$ by $1\frac{3}{4}''$, while the outer support tube 66 has a cross-section of 2" by 2". The lever arm 76 also has a cross-section of $2'' \times 2''$. The height of the weight lifting apparatus 50 from base plate 58 to the top of the housing 52 is approximately 6 feet, while the distance from the rear of base plate 58 to the front of base plate 58 is roughly 5 feet. These dimensions, of course, are exemplary only and can be varied substantially without departing from the scope of the present invention.

The pulley motor 78 may be a $\frac{1}{3}$ hp DC gear motor capable of operating at 1725 rpm and geared down to operate at approximately 27 rpm. This allows the cable to be pulled in or played out at a rate of around 12 feet per minute.

Figure 2:
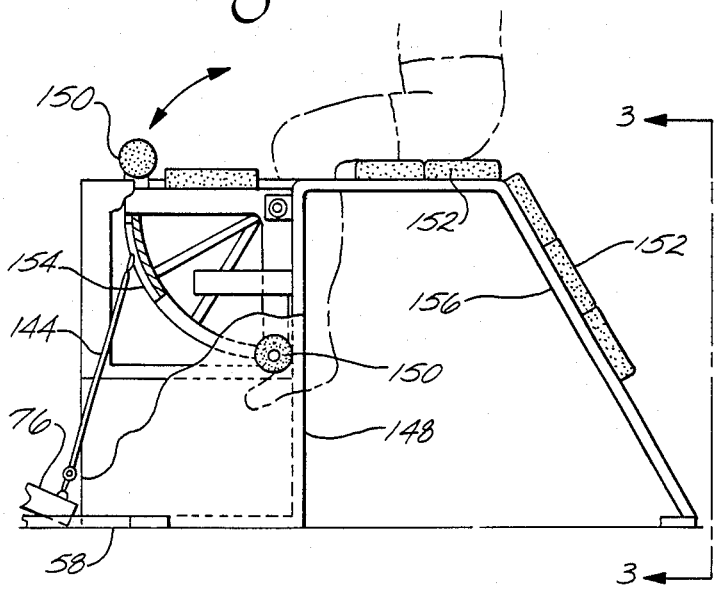
FIG. 2 is a side partial sectional view of a portion of a weight lifting apparatus according to the present invention for exercising the legs and thighs.

During operation of the weight lifting apparatus 50, an upward force is applied to the end of the lever arm 76 as, for example, by the leg and thigh exercising arrangement shown in FIGS. 1 and 2. The carriage 92 and, therefore, the weights 72 slide freely along the track rail 74 on the lever arm 76 as the lever arm is lifted. This effectively increases the resistance felt by the exerciser as the exerciser moves to the top of the exercise cycle. Because of the low frictional engagement between the carriage and the track rail, and the tautness of the cable, the length of the support tube 64 remains substantially constant, and the angle of the support tube relative to the housing 52 increases. Additionally, the angle between the lever arm 76 and the housing also increases. It has been found that the output of a particular muscle group increases as the muscles reach the point of complete contraction. Therefore, in order to fully exercise the muscle group, it is desirable to also increase the effective resistance felt by the exerciser as the exerciser reaches the top of the exercise cycle, i.e., full contraction. This is done by moving the weights further along the lever arm away from the pivot point in the housing. The movement of the weights effectively follows an arc defined by the end of the support between a starting point and an ending point, defining a line which is substantially non-vertical. The process is reversed when the exerciser returns to the starting position during the last half of the exercise cycle.

If the exerciser desires to change the position of the weights with respect to the lever arm at any instantaneous point, the remote control can be used to move the carriage and, therefore, the weights to a new position, as described above. With this design, an exerciser does not have to interrupt the exercise regimen to remove weights in order to be able to continue the exercise regimen to the end. Additionally, a spotter does not need to remove weights while the exerciser is working out. This has several benefits in that the weights need not be changed in discrete amounts, but can be changed along a continuum. Additionally, any one user can maintain the same number of weights on the lever arm for any number of exercises which may be carried out with the interactive means described below. For example, the same number of weights can be left on the weight bar for a bench press as for squats. The exerciser or the spotter need not remove weights in order to change from one exercise regimen to another. All that need be done for a new exercise is to adjust the starting position for the weights and decrease the effective resistance at desired points during the exercise regimen in order to maximize the failure of the muscle sub-groups.

Figure 3:
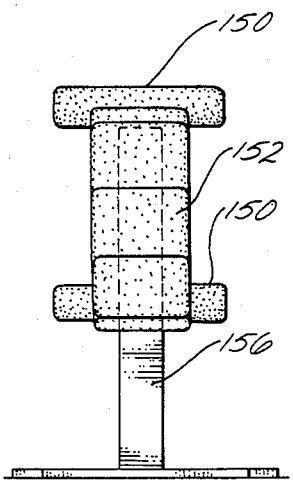
FIG. 3 is a front elevation view of the apparatus of FIG. 2 taken along line 3—3 of FIG. 2.

Various embodiments are shown for exercising different muscles in the body. The apparatus shown in FIG. 1 is used for exercising the leg and thigh muscles. As further shown therein, and in more detail in FIGS. 2 and 3, a seat support 148 rests on the ground in front of lever arm 72. Two roller pads 150 and several seating pads 152 rest on top of seat support 148. Attached to roller pads 34 are two arcuate bars 154 that extend downward to two more roller pads 150. An obtusely angled seat bar 156 extends from the top of seat support 148 outward and downward to rest on the ground. More seat pads 152 are located on seat bar 156. A cable 144 is attached to the upper section of arcuate bars 154 at the cable's topmost end and to the upper surface of lever arm 76 where lever arm 76 rests on the ground. As forward pressure is applied to the bottom of roller pads 150, arcuate bars 154 move along an arc defined by their shape. This forward force is translated to an upward force by the cable 144, since the cable is attached to the top portion of the arcuate bars, which move essentially vertically when the force is applied. The cable exerts an upward force on the lever arm 76, thereby raising the lever arm and the weight bar 70 and weights 72 supported thereon.

Figure 11:
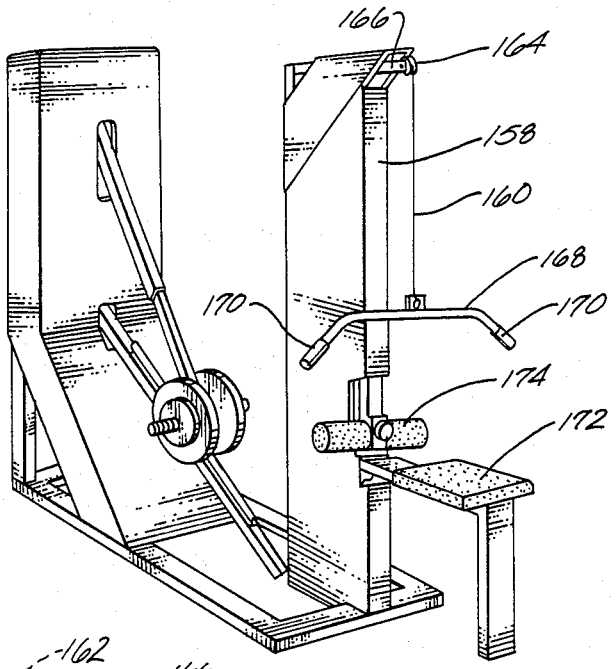
FIG. 11 is a perspective view of an alternative embodiment of the present invention for exercising the latissimus dorsii.
Figure 12:
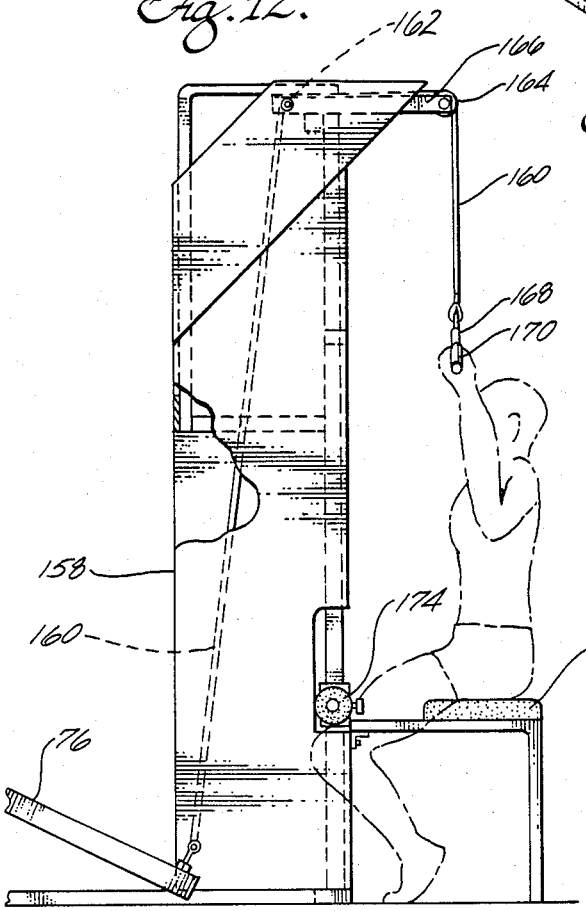
FIG. 12 is a partial side sectional view of the exerciser-interactive portion of the weight lifting apparatus of FIG. 11.
Figure 13:
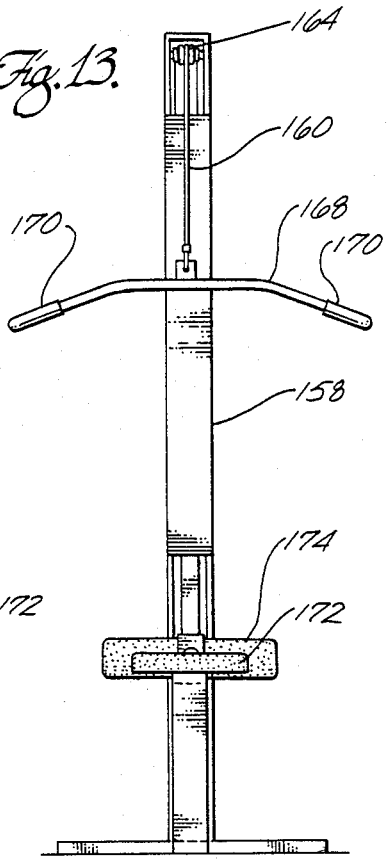
FIG. 13 is a front elevation view of the exerciser-interactive portion of the weight lifting apparatus of FIG. 11.

In an alternative embodiment, as shown in FIGS. 11, 12, and 13, the weight lifting apparatus 50 of the present invention is provided with an exerciser-interactive portion for exercising the latissimus dorsii, or side muscles. A vertical housing 158 rests on the front portion of the base plate 58 just in front of the lever arm 76, being roughly the same height as housing 52. A pulley cable 160 is attached to the top of the end of the lever arm 76 and runs vertically inside vertical housing 158 over pulleys 162 and 164, which are secured to pulley support bar 166. Pulley cable 160 is attached at its other end to a pull bar 168 having handles 170 extending outward at obtuse angles on either side. A bench 172 is attached to the front of vertical housing 158. Roller pads 174 are positioned in the front portion of vertical housing 158 just above the bench 172. As seen in FIG. 12, the exerciser sits on the bench 172 facing the vertical housing 158 with his knees under the roller pads. As the exerciser pulls down on the handles 100 of the pull bar 98, the lever arm and the weights are lifted by the pulley cable, thereby exercising the latissimus dorsii. Holding the knees under the roller pads prevents any reactionary movement of the exerciser's body resulting from the downward pulling force on the pull bar.

Figure 14:
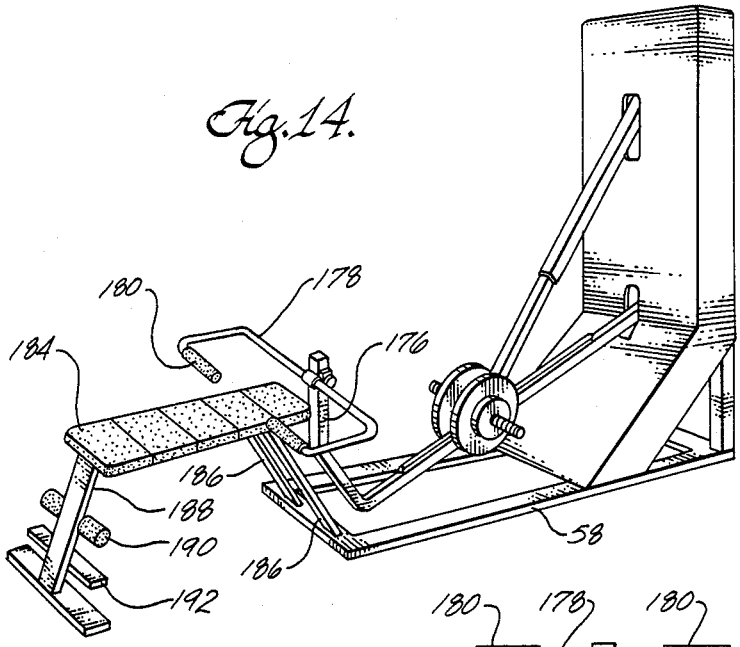
FIG. 14 is a perspective view of an alternative embodiment of the weight lifting apparatus of the present invention for exercising the pectoralis muscles.
Figure 15:
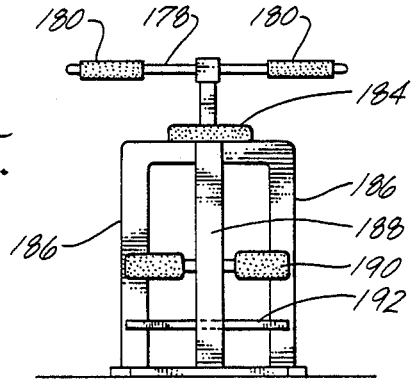
FIG. 15 is a front elevation view of the exerciser-interactive portion of the weight lifting apparatus of FIG. 14.
Figure 16:
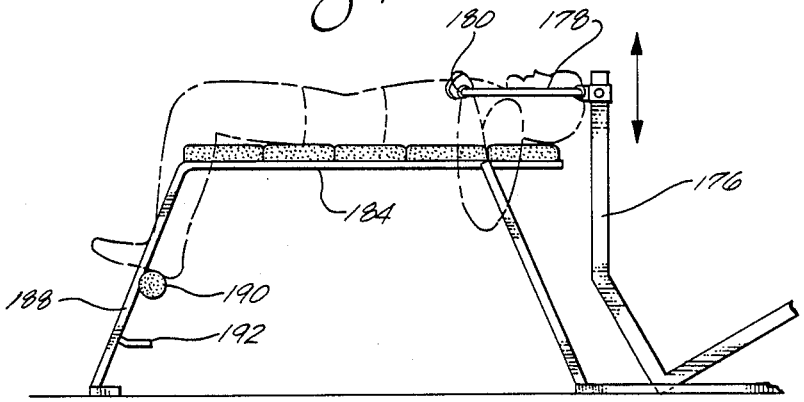
FIG. 16 is a side elevation view of the exerciser-interactive portion of the weight lifting apparatus of FIG. 14 showing an exerciser in exercise position.

Another alternative embodiment is shown in FIGS. 14, 15, and 16 for exercising the pectoralis muscles. The exerciser-interactive portion attached to the principal portion of the weight lifting apparatus 50 comprises a tube section in the form of a height bar 176 that is integral with the lever arm 76. The height bar 176 forms an obtuse angle with the lever arm and has within its own midsection an obtuse angle such that the top portion of the height bar is generally vertical. A C-shaped handle bar 178 having handles 180 is affixed to the height bar by means of a hollow fitting 182 or sleeve having an inner diameter slightly larger than the outer diameter of the height bar for fitting over the height bar and being secured in a particular position thereon. A bench 184 is attached to the base plate 58 by means of parallel bars 186 extending angularly upward from the base plate to the bench. A support leg 188 extends angularly downward from the side of the bench away from the handle bar. Roller pads 190 and a horizontal bar 192 are attached to the support leg 188 to serve as foot rests for an exerciser while using the weight lifting apparatus 50.

As shown in FIG. 16, an exerciser lays prone on the bench, placing his hands on the handles and his feet on the roller pads 190. As the exerciser lifts the handle bar upward, the lever arm containing weights 72 is lifted, thereby exercising the pectoralis muscles.

Figure 17:
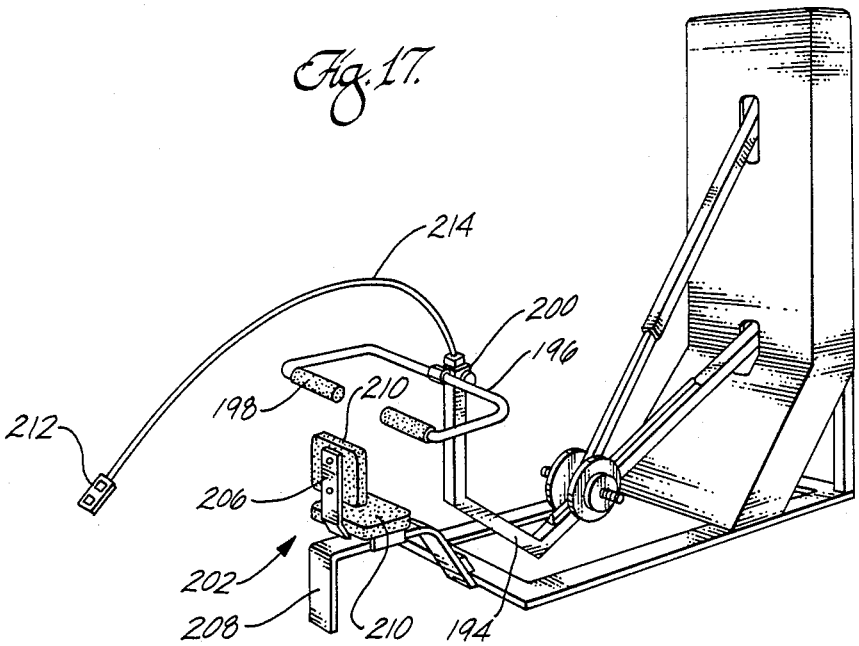
FIG. 17 is a perspective view of an alternative embodiment of the weight lifting apparatus of the present invention for exercising the shoulders and also showing a control switch for controlling movement of the weights along the lever arm, thereby changing the effective resistance.
Figure 18:
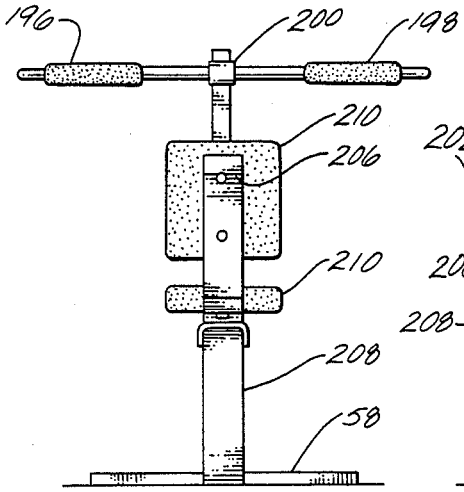
FIG. 18 is a front elevation view of the exerciser-interactive portion of the weight lifting apparatus of FIG. 17.
Figure 19:
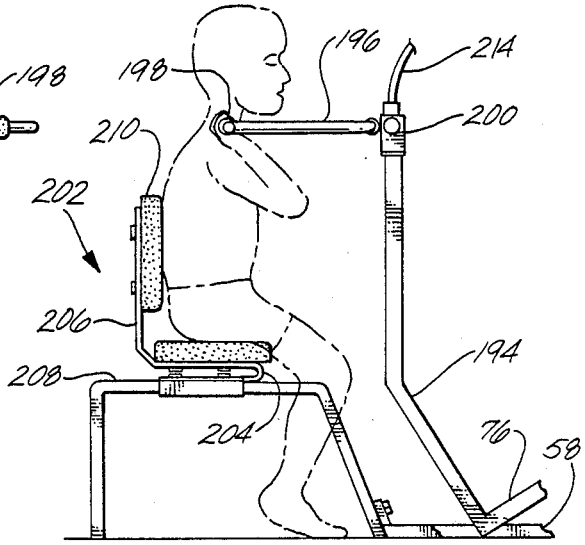
FIG. 19 is a side elevation view of the exerciser-interactive portion of the weight lifting apparatus of FIG. 17.

Another alternative embodiment for exercising the shoulder muscles is shown in FIGS. 17, 18, and 19. The arrangement shown in FIG. 17 is similar to the arrangement shown in FIG. 14, having a tube section in the form of a height bar 194 integral with the lever arm 76 of the same general shape as height bar 176. The embodiment shown in FIG. 17 also has a handle bar 196 having handles 198 and is adjustably fastened to the height bar by fitting 200. A bench 202, comprising a bench base 204 and bench back 206, rests on a bench support 208, as shown in more detail in FIG. 19. Pads 210 cover the bench base and bench back. The bench support is attached to the frontmost portion of the base plate 58. Additionally, in this particular embodiment, a control switch 212 and control cable 214 are shown extending from the interior of the height bar, these being used to send electronic signals to the pulley motor to cause the weight bar holding the weights to move along the lever arm. The control cable runs from the height bar through the lever arm.

In using the weight lifting apparatus shown in FIG. 17, an exerciser sits on the bench and places his hands under the handles 198. Pushing upward on the handles results in the weights on the lever arm being lifted.

Figure 21:
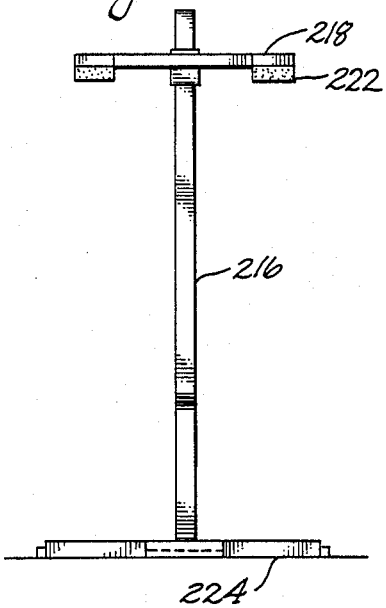
FIG. 21 is a front elevation view of the exerciser-interactive portion of the weight lifting apparatus shown in FIG. 20.
Figure 20:
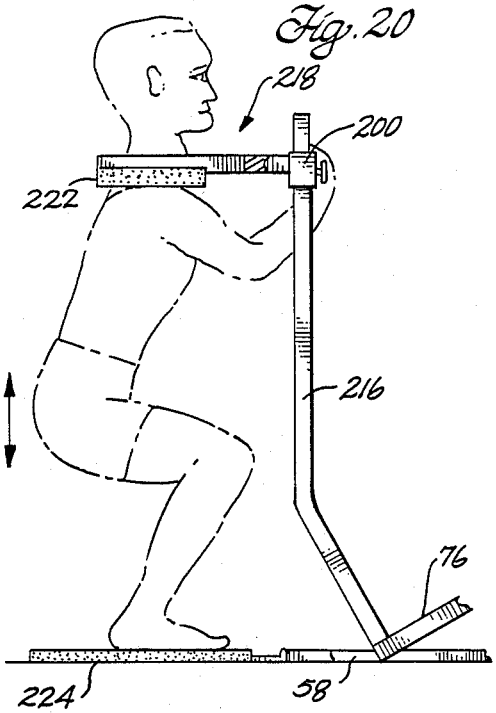
FIG. 20 is a side elevation view of an exerciser-interactive portion of the weight lifting apparatus of the present invention in an alternative embodiment for exercising the legs and calves.
Figure 22:
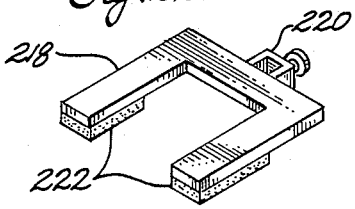
FIG. 22 is a perspective view of the shoulder piece of the exerciser-interactive portion of the weight lifting apparatus shown in FIG. 20.

Another alternative embodiment is shown in FIGS. 20, 21, and 22 for exercising the legs and calves. A height bar 216, of the same general shape as the height bar 194 shown in FIG. 17, having an angular portion and a vertical portion, extends upwardly from, and is integral with or attached to, the lever arm 76. A U-shaped shoulder bar 218 having sides generally equal in length is adjustably fastened to the height bar by fitting 220 of similar configuration to the fitting 200 in FIG. 12. The shoulder bar has pads 222 on the underside of its parallel sides. A base 224 is attached to the frontmost portion of the base plate 58.

When using the exercise apparatus of the present invention with the exerciser-interactive portion, as shown in FIGS. 20, 21, and 22, for exercising the legs and calves, an exerciser stands on the base and, while in a squat position, places his shoulders under the pads 222. The exerciser then stands up into a vertical position, thereby raising the lever arm and exercising the leg muscles. To exercise the calf muscles, the exerciser stands in a vertical position and raises the heels of his feet until he is standing on tiptoes.

Figure 23:
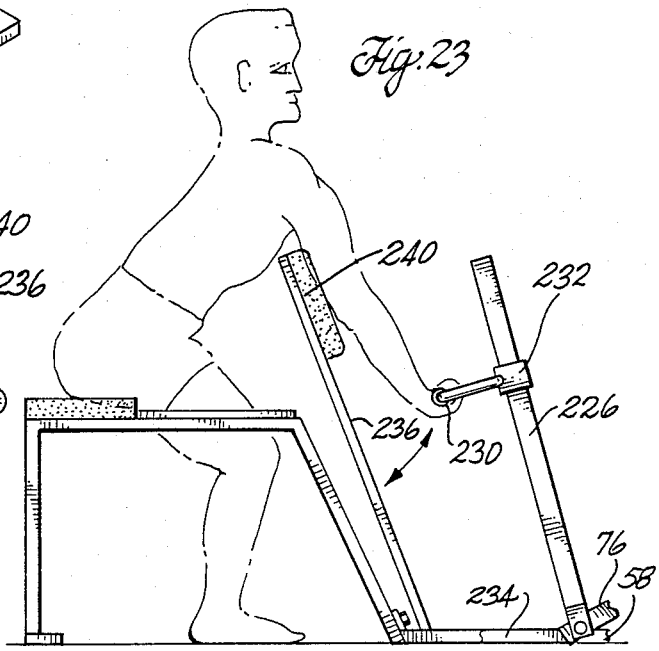
FIG. 23 is a side elevation view of the exerciser-interactive portion of the weight lifting apparatus of the present invention in an alternative embodiment for exercising the biceps showing an exerciser in exercise position.
Figure 24:
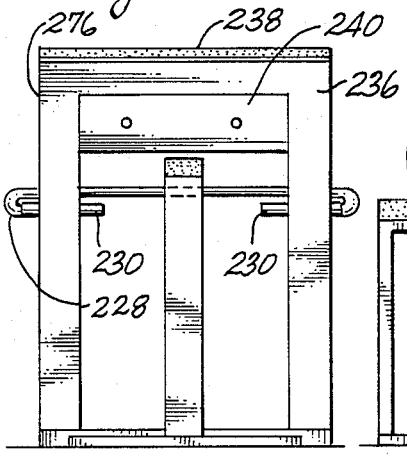
FIG. 24 is a front elevation view of the exerciser-interactive portion of the weight lifting apparatus shown in FIG. 23.

Another alternative embodiment is shown in FIGS. 23 and 24 for exercising the biceps. A straight tube section 226 is pivotally connected to the lever arm 76 through a clevis. A C-shaped handle bar 228 having handles 230 is adjustably attached to tube section 226 by means of a fitting 232 generally similar in configuration to fitting 220 in FIG. 20. A base 234 extends from the front of base plate 58 having two parallel posts 236 connected together by a top post 238 positioned at a generally obtuse angle to base 234. A pad 240 is affixed to the top post 238 and upper portion of the parallel posts 236. A bench may be optionally provided.

To exercise the biceps, an exerciser stands (or sits) behind the top post 238, rests his upper arms on pad 240, and grasps handles 230 of the handle bar in an underhanded fashion. The exerciser then lifts the handle bar in an upward direction by bending his elbows to bring his hands upward toward his upper arms, thereby raising the lever arm 76 and the weights 72.

Figure 25:
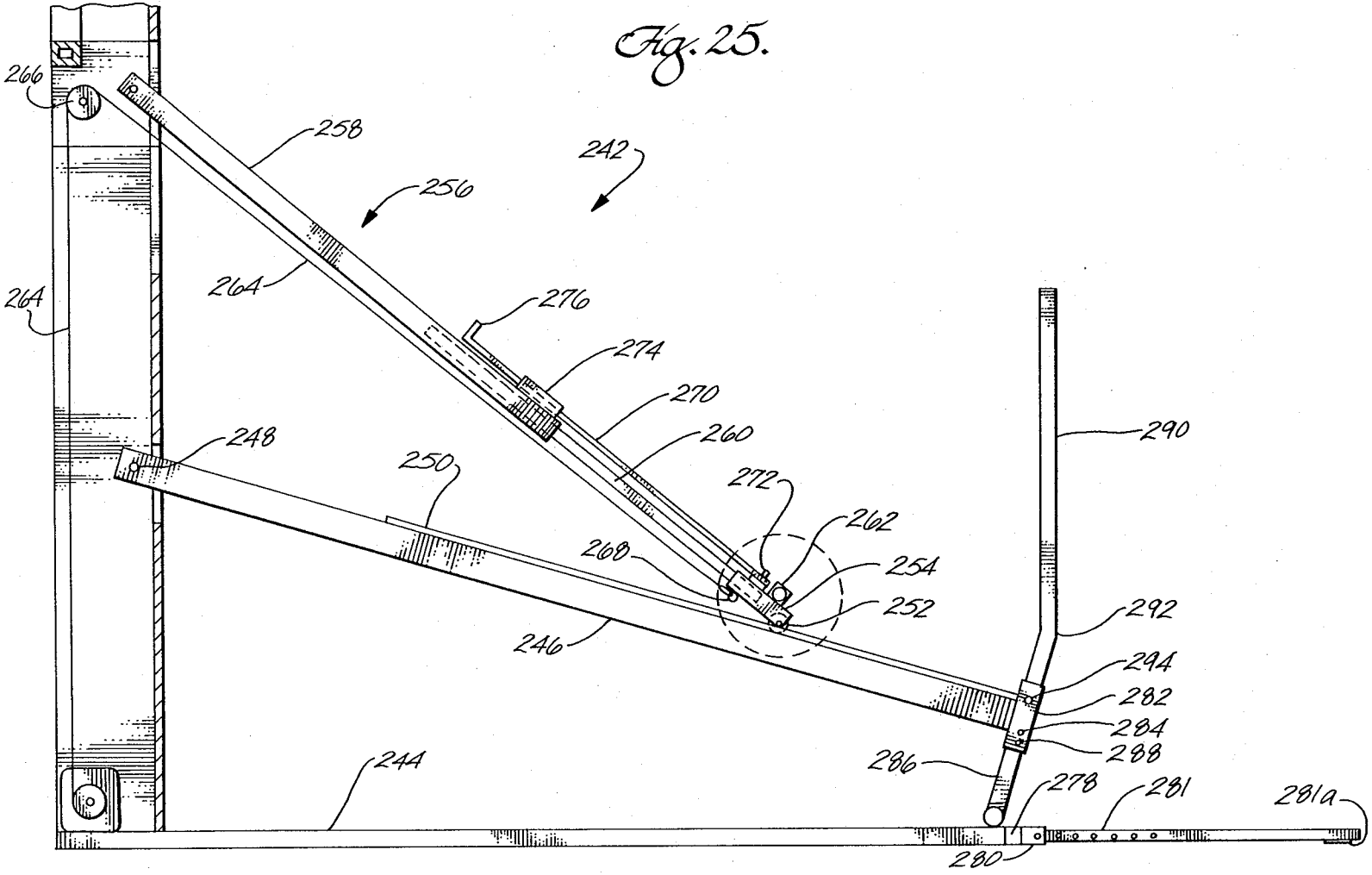
FIG. 25 is a side elevation view of a further embodiment of an exercise apparatus according to the present invention.

FIG. 25 shows an alternate embodiment of an exercise apparatus 242, which is a modification of the exercise apparatus described above with respect to FIGS. 4-6. The structural support for the support tube and for the lever arm may be identical to that described with respect to FIGS. 4–6. A strut (not shown) may extend from the vertical frame to the base plate 244. The lever arm 246 is pivotable with respect to the vertical frame about pivot point 248. The lever arm includes a channel 250 having a U-shaped cross section. The channel accepts and guides one or more rollers 252 rotatably mounted in a clevis 254 fixed to the free end of a support tube 256. The support tube includes an outer tube 258 and an inner tube 260. The outer and inner support tubes are substantially similar to those described with respect to FIG. 4. The clevis fixed to the free end of the inner support tube includes a weight bar 262 transverse to the support tube and the lever arm. A cable 264 passes over an upper pulley wheel 266, and underneath the support tube to be fixed at its end to an eyebolt 268 fixed to the free end of the inner support tube.

A guide tube 270 is fixed to the top of the clevis 254 and includes a lower safety brake 272. The guide tube is spaced from the remainder of the inner support tube and passes through a sleeve 274 mounted to the free end of the outer support tube. The guide tube passes beyond the sleeve 274 and ends in an upper safety brake 276 for preventing excess extension of the inner support tube with respect to the outer support tube. A scale (not shown) may be provided on the top of the guide tube for indicating the effective resistance developed on the lever arm as a function of the extension of the support tube 256. Additionally, limit switches (not shown) may be placed at each end of the sleeve 274 to be contacted by respective safety brakes on the guide tube. Therefore, if the motor is actuated to extend the inner support tube more than is allowed, the upper safety brake will contact its corresponding limit switch to disable the motor. Appropriate circuitry may be provided to allow reverse of the motor to retract the cable. The upper safety brake also prevents injury if the cable were to be cut releasing the lower support and the weight bar and weights.

The base plate 244 preferably extends beyond the end of the lever arm 246. Preferably, the base plate ends in a cross having a transverse bar 278 and an end piece 280 for accepting tubing therewithin, as discussed more fully below.

Ordinarily, an extension tube 281 extends into the end piece 280 and may be adjusted as desired. The extension tube includes a transversely extending floor brace 281*a*. The exerciser uses the extension tube and floor brace when no other attachment, for example, a bench, is used during exercises. The exerciser stands on the floor brace 281*a* while doing the exercises. The extension tube is removed when another attachment is to be made at the end piece 280.

Exercises that can be done with the height bar in place include shrugs to develop the shoulder and upper back muscles, wherein the handle bar is placed in the noninverted position over the height bar and the user stands on the floor brace. Additionally, the handle bar can e used in the same configuration to do upright rowing. If the handle bar is inverted and placed at a higher level on the height bar, the exerciser can do standing presses.

In the particular embodiment shown in FIG. 25, the lever arm terminates in a perpendicular collar 282 having a limit bolt 284, limiting the extent to which a safety leg 286 can pass into the collar. A pin 288 fixes the safety leg in the collar. The safety leg limits the downward movement of the lever arm and, therefore, the user interface. A height bar 290 has a bend 292 so that the height bar is substantially vertical over the majority of its length. The height bar may be fixed in the collar by a removable pin 294.

Various user-engageable means may be mounted over the height bar to conduct various exercises, as will be described more fully below. Additionally, the height bar may be removed and a cable attached to the pin 294 to provide exercises known to those skilled in the art of bodybuilding. Additionally, the safety leg 286 may be removed to provide for greater arcuate motion of the lever arm about its pivot point 248.

Figure 26:
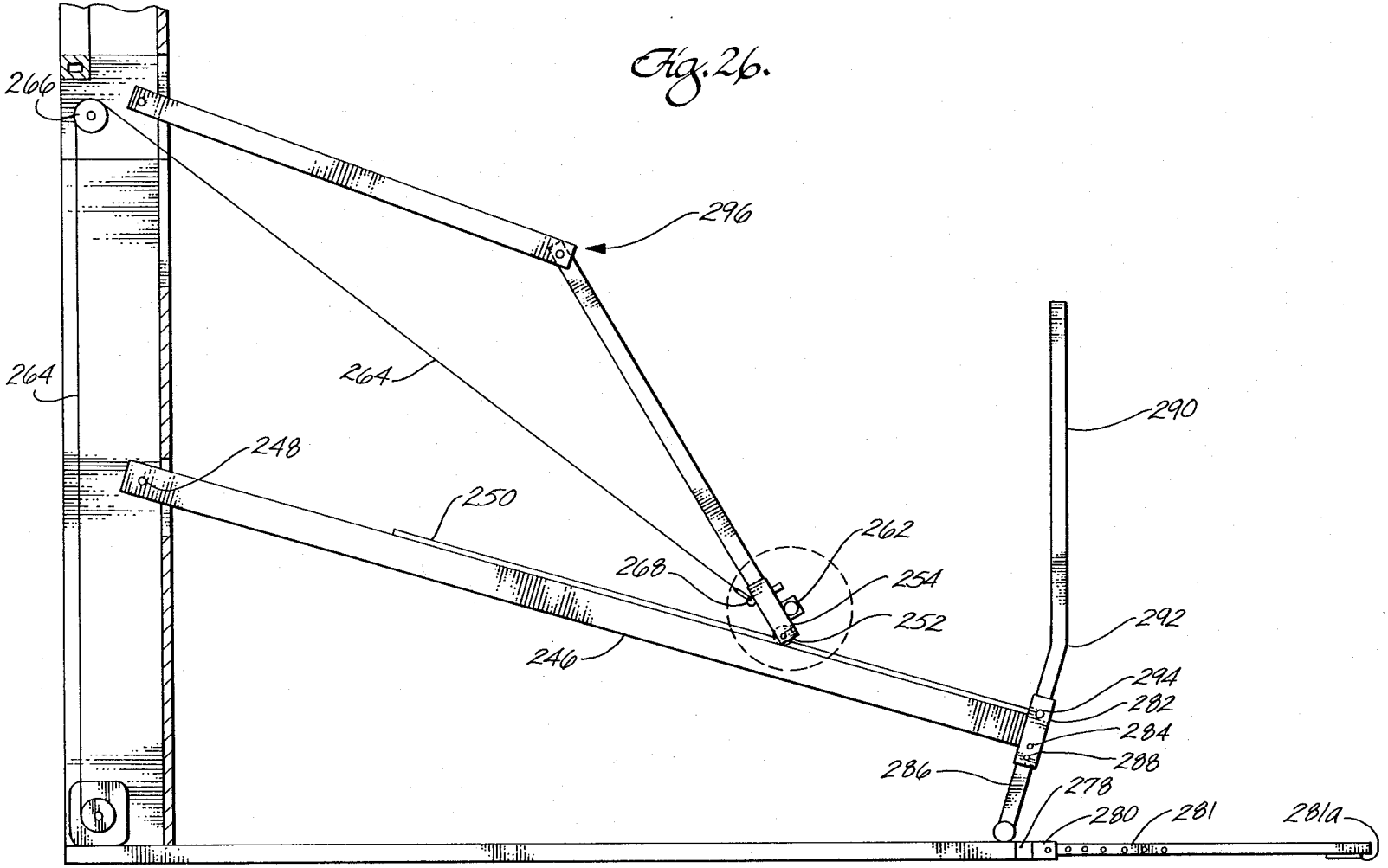
FIG. 26 is a side elevation view of a further embodiment of an exercise apparatus according to the present invention.

FIG. 26 shows an alternative embodiment of the support bar in the form of an articulated support bar 296. The cable 264 passes over the pulley 266 and is attached to the free end of the articulated support bar. The weight bar is mounted to the free end of the support bar in a manner similar to that described with respect to FIG. 25. The function of the articulated support bar is to provide lateral support for the weights and weight bar in conjunction with any lateral support provided by the channel 250. The weights and weight bar are supported in their longitudinal movement in the channel by the cable 264. A spring (not shown) may extend across the joint in the articulated support bar to ensure bending of the support bar in one direction.

Figure 27:
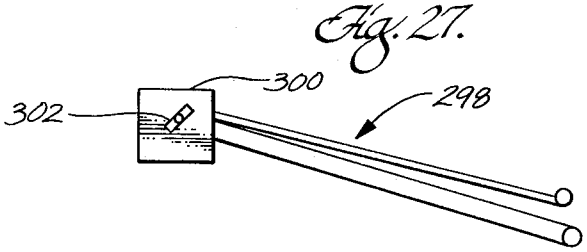
FIG. 27 is a partial perspective view of a handlebar for use on an exercise apparatus such as those shown in FIGS. 25 and 26.

FIG. 27 shows an embodiment of a handle bar 298 having a sleeve 300 for fitting over the height bar 290. The handle bar is angled with respect to the sleeve 300 so that two configurations of the handle bar can be used, depending upon which way the handle bar is mounted on the height bar. For example, the handle bar, as shown in FIG. 27, may be inverted and placed over the height bar to do seated presses within an appropriate seat. The handlebar can be placed over the height bar in a non-inverted position for doing standing presses. The sleeve may include a threaded fastener 302 for reversibly tightening down the handle bar on the height bar. However, the fastener is not necessary in order to maintain the height bar in position during exercises, since the torque developed by the handle bars on the height bar is sufficient to maintain the handle bar in a fixed position.

Figure 28:
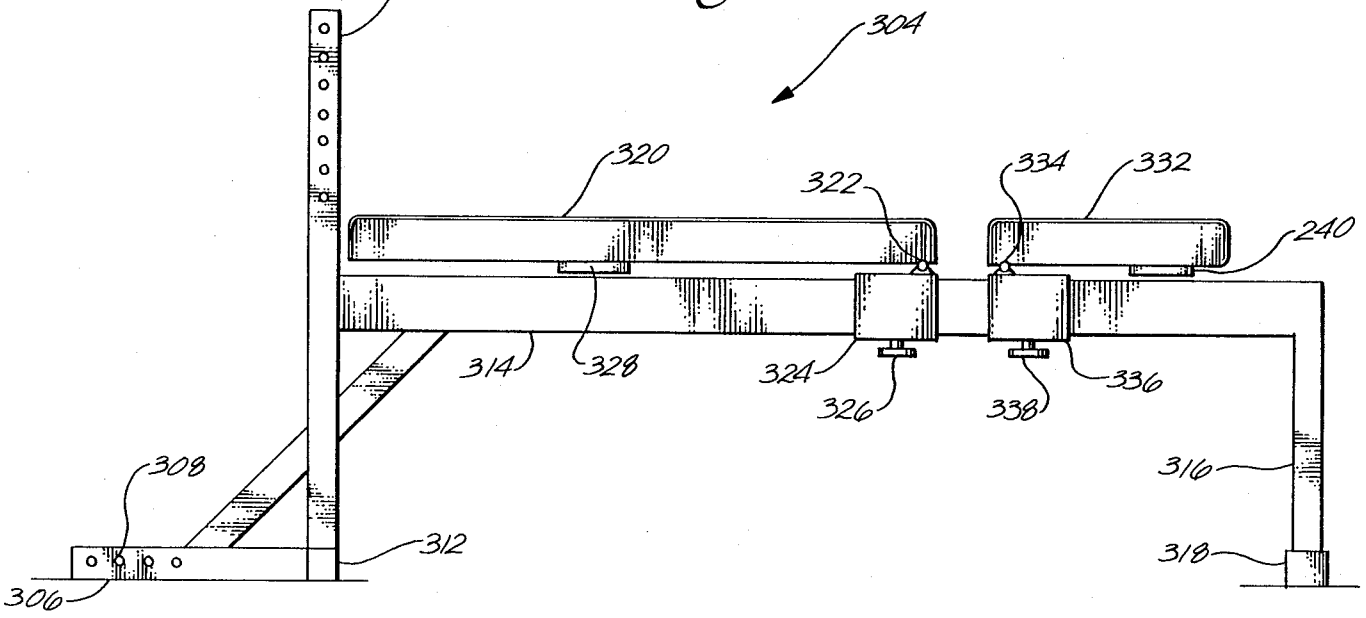
FIG. 28 is a side elevation view of an exerciser-interactive means in the form of a bench for use with an exercise apparatus such as those shown in FIGS. 25 and 26.

FIG. 28 shows an exerciser-interface arrangement in the form of a bench 304. The bench includes a mating tube 306 for mating with the end piece 280 of the base plate 284 on the exercise apparatus. The bench is then adjusted relative to the lever arm, as desired, according to the particular exercise to be carried out. A pin can be passed through the end piece 280 and an appropriate hole 308 in the mating tube to fix the bench with respect to the exercise apparatus. The mating tube intersects with a vertical tube 310 at a right angle. The mating tube also intersects with a transverse floor tube 312 for providing lateral support to the bench. The bench includes a horizontal beam 314 extending above the floor from a midpoint of the vertical tube to an end of the horizontal beam where the beam is coupled to a floor brace 316. The floor brace includes a transverse floor tube 318 for maintaining stability.

Figures 29, 30:
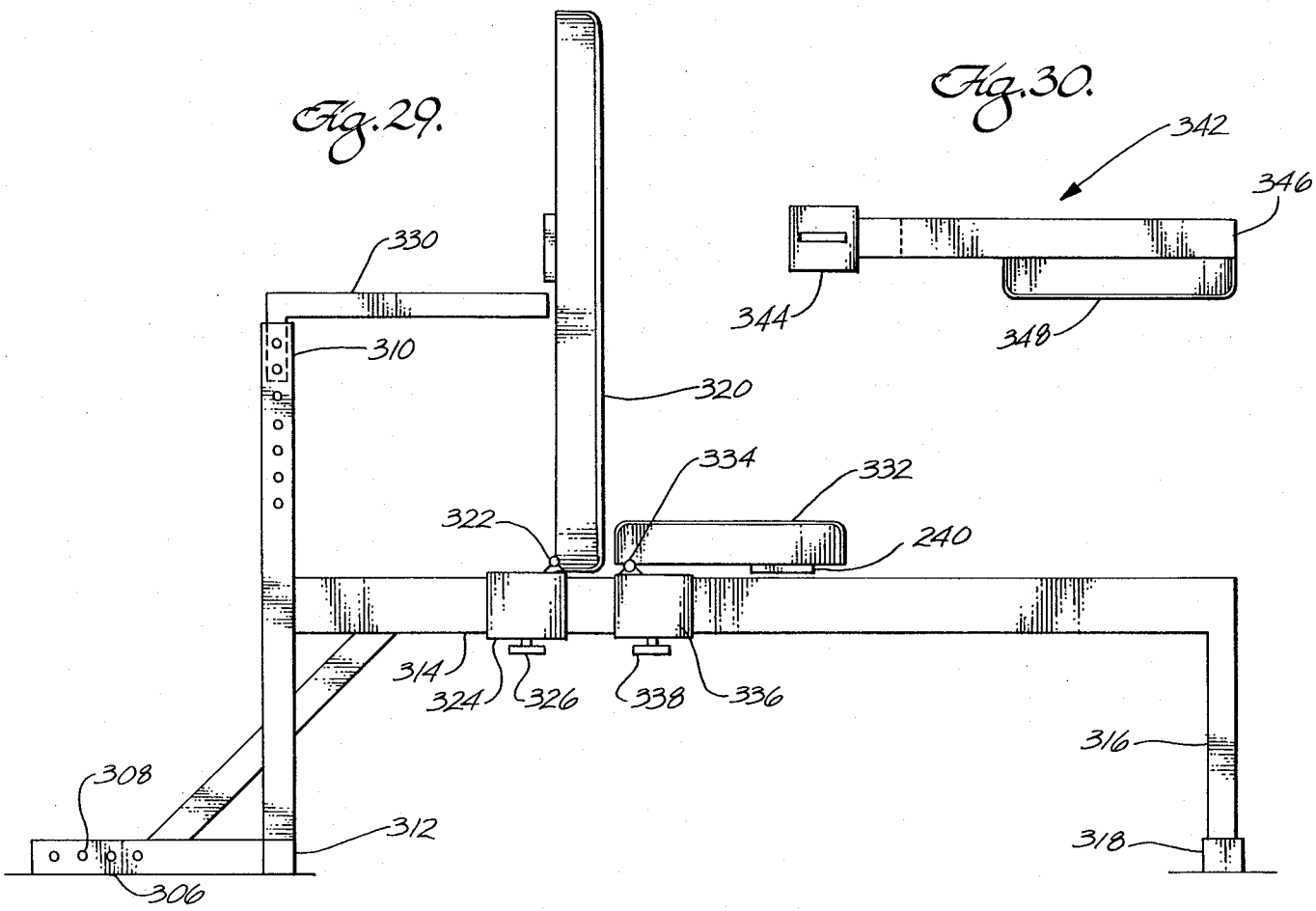
FIG. 29 is a side elevation view of the bench of FIG. 28 in a different configuration.
FIG. 30 is a side elevation view of a shoulder pad arrangement for use on an exercise apparatus such as those shown in FIGS. 25 and 26.

A first long cushion 320 is adjustably mounted to the beam through a hinge 322 and a movable sleeve 324. The cushion can be releasably fixed by a fastener 326, which can be tightened down to the beam 314. A spacer 328 keeps the cushion horizontal with respect to the beam. By loosening the fastener 326, the movable sleeve may be adjusted, and the cushion raised, so that the cushion is vertical, as shown in FIG. 29. The fastener then may be tightened down to keep the large cushion in position. A horizontal brace may be placed in the top of the vertical tube 310 to support the back of the large cushion, as shown in FIG. 29.

A small cushion 332 is also mounted on the beam through a hinge 334 and a movable sleeve 336 to support an exerciser. A releasable fastener 338 fixes the movable sleeve, and therefore the cushion, with respect to the horizontal beam, as desired. A spacer 240 supports the small cushion on the beam. The small cushion may be positioned with the large cushion, as shown in FIG. 29, to support the exerciser. The bench 304, in the configuration shown in FIG. 29, can be used in conjunction with the handle bar and height tube to do behind-the-neck presses.

Other arrangements of the bench shown in FIGS. 28 and 29 can be formed, as would be obvious to one skilled in the art of body building. For example, an incline bench may be formed by moving the large cushion so that the spacer 328 rests on the top of the vertical tube 310. The fastener 326 is then tightened down to fix the large cushion. The small cushion is then moved up against the adjacent end of the large cushion, and the fastener tightened down. A brace can be placed underneath the spacer 240 and against the horizontal beam 314 to put the small cushion at right angles with the large cushion. This configuration is appropriate for inclined bench presses. Inclined bench presses can be carried out by placing the handle bar 298 over the height bar in the noninverted position. The inclined bench can be used to do bent-over rows by lying on the inclined bench using the vertical height bar and the handle bar placed in the noninverted position.

FIG. 30 shows a shoulder pad arrangement 342 having a sleeve 344, a U-shaped tubular element 346, and a pair of cushions 348, one on each leg of the U-shaped tubular member. The shoulder pad arrangement is mounted to the exercise apparatus by placing a sleeve over the height bar of FIG. 25 and placing the shoulders underneath the pads 350. The shoulder pad arrangement is used in conjunction with the extension tube and floor brace to do thigh work, squats, calf work, and deep knee bends.

Figure 31:
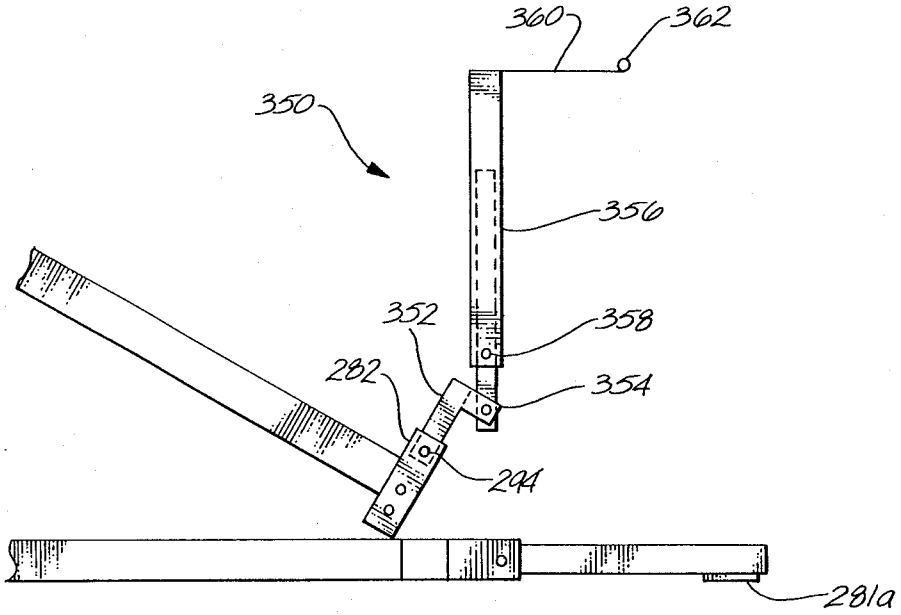
FIG. 31 is a side elevation view of an exerciser-interactive means for use with an exercise apparatus such as those shown in FIGS. 25 and 26.

FIG. 31 shows an attachment omitting the safety bar 286 placed in the collar. The attachment is a curl bar 350 removably fixed in the collar 282. The pin 294 fixes the curl bar in the collar. The curl bar includes a mounting tube 352, having a clevis 354 extending at right angles to the upper end of the mounting tube. An adjustable-height tube 356 is pivotably mounted in the clevis 354 and may include a pin 358 for adjusting the height of the tube. A flange 360 is mounted to the top of the tube and extends away from the exercising apparatus toward the exerciser. Rotatable sleeve handles 362 extend to each side of the free end of the flange.

The curl bar is useful for doing standing curls, wrist curls, etc. while the exerciser stands on the floor brace 281*a*. The curl bar may also be used to do upright rows and standing tricep extensions. It is also possible to do the curl exercises using a cable fixed by pin 294 in the collar, but the cable arrangement would not be free-standing.

Figure 32:
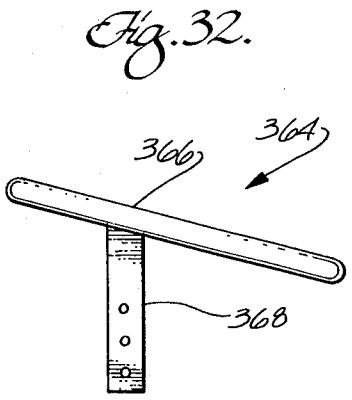
FIG. 32 is a side elevation view of a portion of an exerciser-interactive means for use with the bench of FIG. 28.

FIG. 32 shows a further attachment to the bench 304 of FIG. 28. The attachment is an inclined bench 364 having a cushion 366 and a post 368. The post is inserted into the vertical tube 310 of the bench, and the user can then lie or sit on the inclined cushion. The exerciser will lie backward on the cushion to do lying tricep extensions and will lie on the stomach to do forearm curls.

Figure 33:
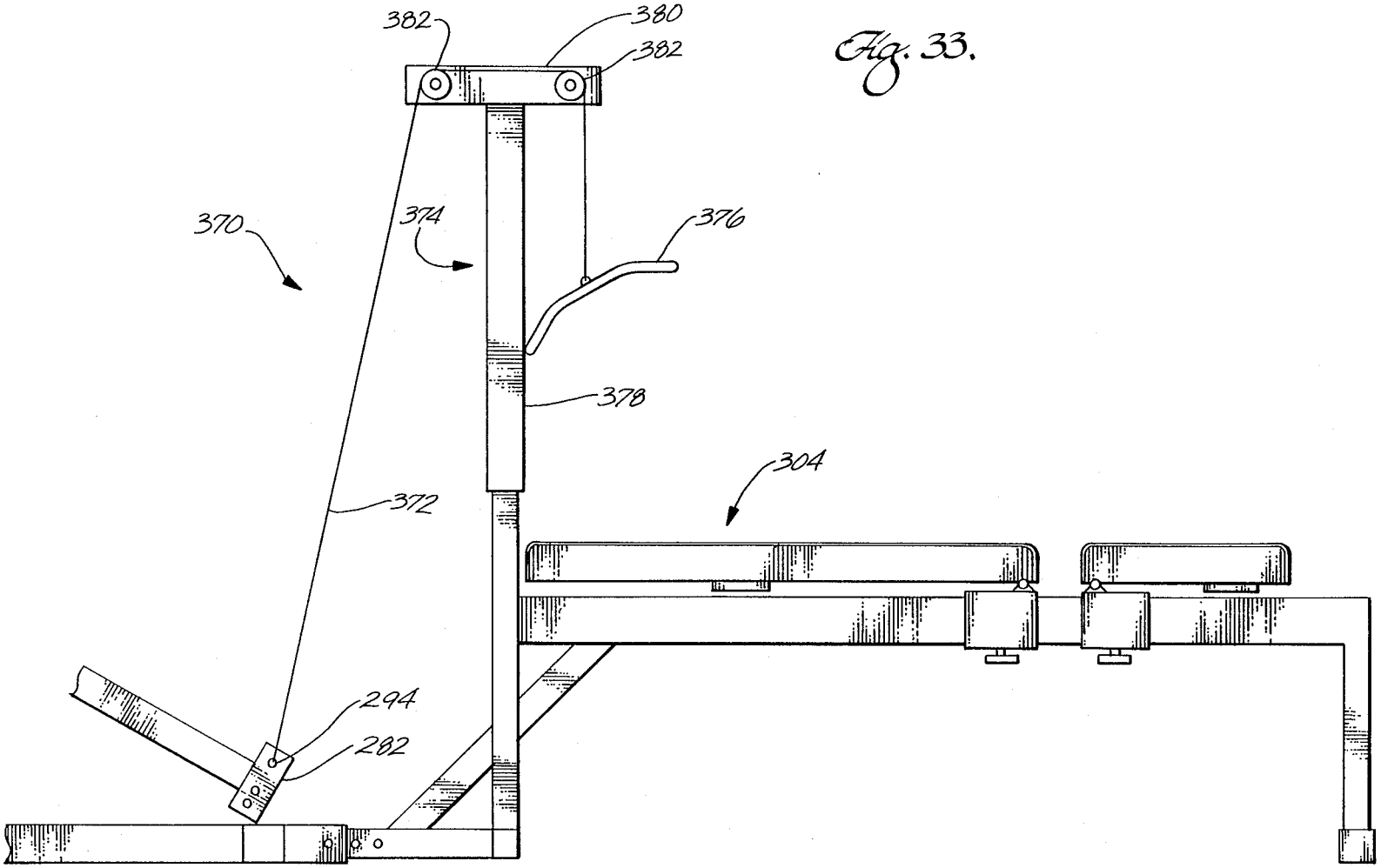
FIG. 33 is a side elevation view of a further embodiment of an exerciser-interactive means in a form of a cable assembly for use in conjunction with the bench of FIG. 28.

FIG. 33 shows a cable and pulley assembly 370 wherein a cable 372 is mounted in the collar 282 through the pin 294. The assembly 370 uses the bench 304, described with respect to FIG. 28, and adds an adjustable T-shaped cable support 374 for supporting the cable and a handle bar 376. The support includes a main tube 378 fitting over the vertical tube 310 and a transverse tube 380 atop the main tube 378. The transverse tube includes a pair of pulley wheels 382 about which the cable passes. The handle bar 376 is mounted to the end of the cable suspended above the bench. This arrangement is useful for lat pull-down exercises, tricep press-down exercises, and others obvious to one skilled in the art of bodybuilding.

In a different structure, the weights may be mounted directly to a carriage on the lever arm, omitting the support bar entirely. In this situation, the resistance felt by the user does not vary according to the pivoting of the lever arm, but can be varied by using the electronic switch to vary the position of the weights on the lever arm through the pulley and cable. The cable would extend over a pulley near the pivot point of the lever arm and extend down to the carriage and weight on the lever arm. Additionally, all weight movements can be pre-programmed if the exerciser's regimen is well-defined. For example, the motor can be driven by a microprocessor pre-programmed to adjust the position of the weights on the lever arm as a function of the number of repetitions completed and also as a function of the arcuate position of the lever arm within a given cycle.

The present arrangement allowing for dynamic change of the resistance during a repetition, and between repetitions, allows training to be carried out in approximately one-sixth the time previously required. This is because the exerciser or a spotter does not have to remove weights from the exercise machine in the middle of the exercise regimen. With the present apparatus, spotters are not even necessary, but are still useful to allow the exerciser to ignore the electronic control and concentrate on the exercises.

FIG. 34 shows a further embodiment of a weight lifting apparatus having a base plate 382 for supporting the remaining structure of the apparatus. The base plate may include pads (not shown) for leveling the base plate. A support structure 384 is mounted to the base plate for supporting a lever arm 386 and means for supporting weights from above in the form of a linear actuator 388. The support structure may be fastened through bolts or other fasteners (not shown) to the base plate 382. The support structure is made from two generally U-shaped and nonplaner square tubes. The first tube 390 is inverted and has each of its legs fastened to respective sides of the base plate through mounting brackets. Each of the legs of the first extend upwardly and toward the other end of the base plate until it meets the second U-shaped tube 392. The second tube is also inverted and respective legs mounted to opposite portions of the base plate 382 at points part way between each end of the base plate. The legs extend upward and toward the first tube until the first and second tubes meet. Thereafter, the second tube extends to a top for supporting the linear actuator and the first tube extends to a point midway toward the top of the second tube. There is a bend in each of the first and second tubes at the point where the first and second tubes meet.

At the bend of the first and second tubes, the lever arm 386 is supported through a rod 394 for pivotally supporting the lever arm. The rod is mounted through bearing assemblies 396. The lever arm extends from the rod 394 down toward the base plate 382 to a height bar assembly 398. The height bar assembly is mounted to the end 400 of the lever arm. The height bar assembly includes an elbow 402 and a strut 404. Other exerciser-interface assemblies can be placed in the end of the lever arm as a substitute for the height bar assembly 398. Handlebars 406 are mounted to the height bar through a sleeve 408.

A carriage 410 supports a weight bar 412 for carrying weights (not shown). The carriage is supported from above by the linear actuator 388 and by rollers 414 in the carriage. The carriage is movable along the lever arm according to the position of the lever arm and to the extension or retraction of the linear actuator. The weight bar 412 extends completely through both plates 416 of the carriage. The carriage and linear actuator are described more fully below with respect to FIG. 36.

The linear actuator is supported from a mid-portion of the second tube 392 through a bracket mounting 418 and a pin passed through a swivel bearing 420 between opposite flanges of the bracket. The linear actuator is one such as manufactured and sold by Warner Electric under model number P24-05B524RD. The stroke may be 26 to 30 inches with a capacity of 800 pounds minimum. The minimum speed may be approximately 1½ inches per second. The linear actuator includes a motor 422 for driving the actuator. The motor may include means for feeding back information with respect to the position of the actuator. The feedback may be used to provide an output to the exerciser indicating the effective weight being manipulated.

FIG. 35 shows a cross-section of the rod 394 and a side elevation view of a portion of the lever arm 386. The rod is welded along appropriate portions thereof to a flanged portion 424, each of which are welded to the side of the lever arm. An identical rod is on the opposite side of the lever arm and is similarly mounted to the support structure.

FIG. 36 shows a detail of the carriage 410 including weight bar 412 and four bearings 414, two rotatably mounted above the lever arm and two rotatably mounted below the lever arm. Each bearing includes a sealed bearing assembly (not shown) for minimizing any frictional forces. The linear actuator is coupled to the carriage through a link pin 426 passing between the two carriage plates 416. The linear actuator supports the carriage through the link pin due to the gravitational pull on the carriage and weights when the lever arm is below horizontal. A lost motion coupling comprising a slot 428 in an outer portion of the actuator and a pin 430 interior to the actuator and movable in the slot is coupled to a swivel bearing 432.

FIG. 37 shows the exercise apparatus of FIG. 34 in combination with an exerciser-interactive assembly in the form of an incline bench assembly 434. The assembly includes an incline bench 436 and a perpendicular support 438. The perpendicular support includes a fastener 440 for adjusting the perpendicular support. The incline bench and the exerciser-interactive arrangement is used in a manner similar to that described above with respect to FIG. 16.

FIG. 38 shows an exerciser-interactive means in the form of a thigh arrangement including a shoulder pad assembly 442 having a contoured cushion 444. The shoulder pad assembly is mounted to the height bar 398 through a sleeve 446 and is adjustable through fastener 448. The height bar is coupled to the lever arm 386 in a manner similar to that described above with respect to FIG. 34. The base plate 382 may include an extension 450 on which the exerciser can stand.

FIG. 39 shows a further embodiment of an exerciser-interactive arrangement including a seat 452 comprising a horizontal cushion 454 and an adjustable vertical cushion 456. A support leg 458 supports the horizontal cushion along with a vertical support 460. The vertical support rests on the base plate 460. The vertical cushion is mounted to an upper portion of the vertical support 460 and is adjustable along the length of pin 462 through a fastener 464. The handle bars 406 are adjustable along the height bar 398 through fastener 466. The exerciser-interactive assembly of FIG. 39 is used in a manner similar to that described with respect to FIG. 29.

FIG. 40 shows an exerciser-interactive arrangement for doing curls, etc. A T-bar assembly 468 is mounted to the end of the lever arm 386 and is pivotably about a pin 470 and in the end of the lever arm. The T-bar assembly includes an outer sleeve 472 adjustable over the tube 474. The tube 474 is pivotally mounted to the lever arm through pin 470. The assembly includes a seat 476 adjustably mounted in vertical collar 478, and adjustable through fastener 480. Arm cushion 482 is adjustably mounted in a second vertical support 484, and is adjustably through fastener 486. The seat and arm cushion are mounted to the base plate 382 through an elbow 488. The curl assembly is used in a manner similar to that described with respect to FIG. 23.

It is to be understood that any or all of the exercising apparatus described with respect to FIGS. 34–40 can and preferably do include electronic switch means for movably positioning the weights along the lever arm 386.

FIG. 40A shows a schematic block diagram of the electronic control circuit for the present invention. Line power is input from plug 490 to the AC or DC power supply 492. DC input is provided to a 24-volt DC control circuit 494. This provides power to the electronic circuit 496 which controls the motor 498 for changing the position of the weights on the lever arm. The motor controls the linear actuator or cable 500. An exercising hand or foot control 502 or a spotter control 504 provide input to the electronic circuit, in parallel, to control the motor. Digital feedback 506 may be provided to the exerciser based on actuation of the motor.

The linear actuator may include limit switches to limit the extension retraction of the actuator.

It should be apparent the foregoing description and drawings that the weight lifting apparatus of the present invention provides a novel means for exercising the muscles of the body completely so that all of the submuscle groups fail during a particular exercise. This is made possible by the effective resistance being continuously variable and being controlled by the exerciser from the exercise position during an exercise stroke. Moreover, the weight lifting apparatus of the present invention is relatively simple and inexpensive to construct and has the added advantage that the same base unit can be constructed with different exerciser-interactive sections to provide different pieces of equipment for exercising all of the parts of the body.

It will be apparent to those skilled in the art that other stabilizing units might be constructed without departing from the spirit and scope of the present invention. Thus, the foregoing description and drawings are meant for illustrative purposes only, and the present invention is not intended to be limited in any way, except as by the appended claims.

What is claimed is:

1. Weight biased exercise apparatus for exercising various muscle groups in the body of an apparatus user placed in a selected exercise position adjacent the apparatus, the apparatus comprising:

a foundation frame, an elongate main lever pivotally connected at one end thereof to the frame and connectable at an opposite end thereof to selected devices via which a user can apply force to the lever to move the lever between spaced ends of a range of lever motion, a weight carriage on the lever moveable along a selected portion of the elongate extent of the lever for receiving and carrying a weight of selected magnitude, the carriage and the lever being cooperatively defined so that the carriage is biased by gravity to move in one direction along the lever throughout motion of the lever within said range, and a user-controllable mechanism operable at the will of a user for moving the carriage along the lever.

2. Apparatus according to claim 1 including means for constraining the carriage from uncontrolled motion in the one direction along the lever under the influence of gravity and for enabling the carriage to move along the lever in response to motion of the lever within said range.

3. Apparatus according to claim 2 wherein the lever in configured so that, over said selected portion of its elongate extent and at positions of the lever within said range, the lever either slopes in a selected direction relative to its pivoted end or is horizontal, the means for constraining and for enabling the carriage includes tensilely loaded tether means coupled from the carriage to a position on the frame separate from the lever.

4. Apparatus according to claim 3 wherein the position on the frame is adjacent the pivoted one end of the lever.

5. Apparatus according to claim 3 wherein the position on the frame is above the pivoted connection of the one end of the lever to the frame.

6. Apparatus according to claim 3 wherein the position on the frame is adjacent to and above the pivoted one end of the lever, and the lever is configured over said selected portion of its elongate extent to slope downwardly away from the lever one end when the opposite lever end is at a lower end of said range.

7. Apparatus according to claim 3 wherein the user-controllable mechanism is operable for altering the effective length of the tether means between the carriage and the position on the frame.

8. Apparatus according to claim 7 wherein the tether means includes an elongate flexible tensilely loadable member.

9. Apparatus according to claim 8 wherein the flexible member comprises a cable.

10. Apparatus according to claim 7 wherein the user-controllable mechanism comprises a linear actuator.

11. Apparatus according to claim 10 wherein the linear actuator is disposed between the carriage and said position on the frame.

12. Apparatus according to claim 3 wherein the user-controllable mechanism includes, as a component thereof and of the means for constraining and enabling the carriage, a motor mounted to the frame, and an elongate flexible member coupled from the motor to the carriage via said position on the frame.

13. Apparatus according to claim 12 including a reel driven by the motor and to which the flexible member is connected.

14. Apparatus according to claim 1 including means coupled between the frame and the lever for substantially counteracting and offsetting the weight of the lever so that the effective load against which a user applies force to move the lever is principally due to the carriage and the magnitude of a weight received on the carriage and the position of the carriage on the lever.

15. Weight biased exercise apparatus for exercising various muscle groups in the body of an apparatus user placed in a selected exercise position adjacent the apparatus, the apparatus comprising:

a foundation frame, an elongate main lever pivotally connected at one end thereof to the frame and connectable at an opposite end thereof to selected devices via which a user can apply force to the lever to move the lever between spaced ends of a range of lever motion, a weight carriage on the lever moveable along a selected portion of the elongate extent of the lever for receiving and carrying a weight of selected magnitude, the carriage and the lever being cooperatively defined so that the carriage is biased by gravity to move in one direction along the lever throughout motion of the lever within said range, and tensilely loaded tether means coupled from the carriage to a position on the frame separate from the lever for constraining the carriage from uncontrolled movement in the one direction along the lever and for enabling the carriage to move along the lever in response to movement of the lever within said range.

16. Apparatus according to claim 15 wherein the lever is configured so that, over said selected portion of its elongate extent and at positions of the lever within said range, the lever either slopes in the one direction or is horizontal.

17. Apparatus according to claim 16 wherein the position on the frame is adjacent the pivoted one end of the lever.

18. Apparatus according to claim 16 wherein the position on the frame is above the pivoted one end of the lever.

19. Apparatus according to claim 16 wherein the position on the frame is adjacent to and above the pivoted one end of the lever, and the lever is configured over said selected portion of its elongate extent to slope downwardly away from the lever one end when the opposite lever end is at a lower end of said range.

20. Apparatus according to claim 16 wherein the tether means includes an elongate flexible tensilely loadable member.

21. Apparatus according to claim 20 wherein the flexible member comprises a cable.

22. Apparatus according to claim 16 including user-controllable means operable for altering the effective length of the tether means between the carriage and the position on the frame at the will of a user.

23. Apparatus according to claim 22 wherein the user-controllable mechanism includes a linear actuator.

24. Apparatus according to claim 23 wherein the linear actuator is disposed between the carriage and said position on the frame.

25. Apparatus according to claim 22 wherein the user-controllable means includes a motor mounted to the frame and an elongate flexible member coupled from the motor to the carriage via said position on the frame.

26. Apparatus according to claim 25 including a reel driven by the motor and the which the flexible member is connected.

27. Apparatus according to claim 15 including means coupled between the frame and the lever for substantially counteracting and offsetting the weight of the lever so that the effective load against which a user applies force to move the lever is principally due to the carriage and the magnitude of a weight received on the carriage and the position of the carriage on the lever.

28. Weight biased exercise apparatus for exercising various muscle groups in the body of an apparatus user placed in a selected exercise position adjacent the apparatus, the apparatus comprising a foundation frame, an elongate main lever pivotally connected at one end thereof to the frame and connectable at an opposite end thereof to selected devices via which a user can apply force to the lever to move the lever between spaced ends of a range of lever motion, a weight carriage on the lever moveable along a selected portion of the elongate extent of the lever for receiving and carrying a weight of selected magnitude, the said portion of the lever sloping downwardly toward the lever opposite end at positions of the lever within said range, and tether means coupled between the carriage and a location on the frame adjacent to and spaced from the lever one end for constraining the carriage from uncontrolled movement down the sloping portion of the lever and for enabling the carriage to move along said portion of the lever in response to motion of the lever within said range.

29. Apparatus according to claim 28 wherein the position on the frame is above the lever one end.

30. Apparatus according to claim 28 wherein the tether means includes an elongate tensilely loaded flexible member.

31. Apparatus according to claim 30 wherein the flexible member comprises a cable.

32. Apparatus according to claim 28 including user-controllable means operable at the will of a user for altering the effective length of the tether means between the carriage and the position on the frame.

33. Apparatus according to claim 32 wherein the user-controllable means includes a linear actuator.

34. Apparatus according to claim 33 wherein the linear actuator is disposed between the carriage and the location on the frame.

35. Apparatus according to claim 32 wherein the user-controllable means comprises a motor connected to the frame, and an elongate flexible member coupled at one end to the carriage and at an opposite end to the motor for movement in response to operation of the motor.

36. Apparatus according to claim 28 including means coupled between the frame and the lever for substantially counteracting and offsetting the weight of the lever so that the effective load against which a user applies force to move the lever is principally due to the carriage and the magnitude of a weight received on the carriage and the position of the carriage on the lever.

37. An exercise apparatus comprising a support, a lever arm pivotally mounted to the support adjacent a first lever end, user-engageable means adjacent a second end of the lever arm for enabling a user to pivot the lever arm, resistance means comprising weights movable along the lever arm a distance between the first and second lever ends and having a longitudinal component of motion with respect to the support, and means independent of the lever arm for moving the weights along the lever arm and including a motor, a telescoping tube, and a cable disposed at least partially within the tube.

38. The apparatus as claimed in claim 37 wherein the lever arm comprises a track along which the resistance means is movable along the lever arm.

39. The apparatus as claimed in claim 37 wherein the resistance means comprises a carriage movable along the lever arm.

40. A weight lifting apparatus for exercising various muscle groups in the body of an apparatus user placed in a selected exercise position by moving said muscle groups against an effective resistance, said apparatus having a frame and comprising a lever arm to which a force is directly or indirectly applied by a person exercising at one end of the arm and which pivots about a fixed point mounted to said frame at an opposite arm end, means for movably positioning at least one weight to be lifted on said lever arm between the point of application of the force to the lever arm and the point about which the lever arm pivots such that the weight can be positioned at different locations on the lever arm, thereby changing the effective resistance against the force, said means comprising a pulley system having a pulley cable and a motor driving a pulley wheel and means for connecting the pulley cable to the weight such that the weight is pulled downward by gravity along the lever arm until the cable is taut, the position of the weight on the lever arm being adjustable by winding and unwinding the cable around the pulley wheel, and means for permitting the user to control the movement of the weight along the lever arm independent of the lever arm movement while the user is in the exercise position.

41. The weight lifting apparatus of claim 40 wherein the means for connecting said pulley cable to the weight comprises a member, one end thereof having the weight attached to it and the other end thereof having the pulley cable attached to it.

42. The weight lifting apparatus of claim 41 wherein the member is sized to fit slidably into a second member, the first member moving in and out of the second member as the position of the weight on the lever arm changes.

43. The weight lifting apparatus of claim 40 wherein said means for permitting said user to control the movement of the weight comprises an electrical circuit controlling the winding and unwinding of the cable about the motor pulley wheel.

44. The weight lifting apparatus of claim 40 wherein the means for controlling the movement of said weight from the exercise position is such that the position of the weight along the lever arm can be changed during an exercise stroke.

* * * * *